US011274008B2

(12) United States Patent
Okada et al.

(10) Patent No.: US 11,274,008 B2
(45) Date of Patent: Mar. 15, 2022

(54) POST-PROCESSING APPARATUS

(71) Applicant: KYOCERA Document Solutions Inc., Osaka (JP)

(72) Inventors: Rina Okada, Osaka (JP); Yasunori Ueno, Osaka (JP); Terumitsu Noso, Osaka (JP)

(73) Assignee: KYOCERA Document Solutions Inc.

( * ) Notice: Subject to any disclaimer, the term of this patent is extended or adjusted under 35 U.S.C. 154(b) by 880 days.

(21) Appl. No.: 15/944,838

(22) Filed: Apr. 4, 2018

(65) Prior Publication Data

US 2018/0290852 A1 Oct. 11, 2018

(30) Foreign Application Priority Data

Apr. 7, 2017 (JP) ..... JP2017-076853
Apr. 12, 2017 (JP) ..... JP2017-078923

(51) Int. Cl.
*B65H 31/10* (2006.01)
*B65H 31/24* (2006.01)
(Continued)

(52) U.S. Cl.
CPC ..... *B65H 31/24* (2013.01); *B65H 29/22* (2013.01); *B65H 29/246* (2013.01); *B65H 31/02* (2013.01); *B65H 31/10* (2013.01); *B65H 31/34* (2013.01); *B65H 43/00* (2013.01); *B65H 43/06* (2013.01); *G03G 15/6552* (2013.01);
(Continued)

(58) Field of Classification Search
CPC ..... B65H 31/24; B65H 29/22; B65H 29/246; B65H 31/02; B65H 31/34; B65H 43/00; B65H 43/06; B65H 31/30; B65H 29/68; B65H 29/24; B65H 29/245; B65H 37/04; B65H 2408/12; B65H 2301/42262;
(Continued)

(56) References Cited

U.S. PATENT DOCUMENTS 6,889,971 B2 * 5/2005 Tamura ..... B42B 2/00 270/58.08
8,915,492 B2 * 12/2014 Sugiyama ..... B65H 31/36 270/58.12
(Continued)

FOREIGN PATENT DOCUMENTS

JP 2013-136453 7/2013
JP 2013-184809 9/2013

*Primary Examiner* — Thomas A Morrison
(74) *Attorney, Agent, or Firm* — Gerald E. Hespos; Michael J. Porco; Matthew T. Hespos

(57) ABSTRACT

Post-processing apparatus for performing given process subsequently to image forming process by image forming apparatus is disclosed. Post-processing apparatus includes: first ejector which ejects sheet; first tray which temporarily holds sheet; second tray situated downstream of first tray in ejection direction of sheet; a tray driver which moves second tray downwardly from first height position; blower which forms airstream between second tray and lower surface of sheet; and controller which controls blower and tray driver. Controller includes: blower controller which causes blower to blow air over time period in synchronization with first time period from start to end of sheet ejection by first ejector; and tray controller which causes tray driver to move second tray downwardly from first height position after first time period.

19 Claims, 20 Drawing Sheets

(51) Int. Cl.

| | |
|---|---|
| ***G03G 15/00*** | (2006.01) |
| ***B65H 29/22*** | (2006.01) |
| ***B65H 31/34*** | (2006.01) |
| ***B65H 29/24*** | (2006.01) |
| ***B65H 43/06*** | (2006.01) |
| ***B65H 31/02*** | (2006.01) |
| ***B65H 43/00*** | (2006.01) |

(52) U.S. Cl.
CPC . *G03G 15/6573* (2013.01); *B65H 2301/4212* (2013.01); *B65H 2301/4213* (2013.01); *B65H 2301/4461* (2013.01); *B65H 2405/11151* (2013.01); *B65H 2406/10* (2013.01); *B65H 2511/51* (2013.01); *B65H 2511/515* (2013.01); *B65H 2513/40* (2013.01); *B65H 2513/51* (2013.01); *B65H 2801/27* (2013.01)

(58) Field of Classification Search
CPC ..... B65H 2301/5305; G03G 15/6552; G03G 15/6573; B42C 1/12
See application file for complete search history.

(56) References Cited

U.S. PATENT DOCUMENTS

| | | | | |
|---|---|---|---|---|
| 2007/0284801 | A1* | 12/2007 | Hayashi ..... | B65H 37/00 270/58.07 |
| 2012/0161379 | A1* | 6/2012 | Matsui ..... | B65H 31/02 270/58.17 |
| 2013/0134659 | A1 | 5/2013 | Konno et al. | |
| 2013/0236228 | A1 | 9/2013 | Nagasako et al. | |
| 2015/0253716 | A1 | 9/2015 | Nagasako et al. | |

* cited by examiner

POST-PROCESSING APPARATUS

INCORPORATION BY REFERENCE

This application is based on Japanese Patent Application Serial Nos. 2017-076853 and 2017-078923 filed in Japan Patent Office, respectively, on Apr. 7, 2017 and Apr. 12, 2017, the contents of which are hereby incorporated by reference.

BACKGROUND

The present disclosure relates to a post-processing apparatus for performing a given process subsequently to an image forming process by an image forming apparatus.

Known image forming apparatuses are configured to incorporate a blower into an ejection mechanism for ejecting a sheet. One of the known image forming apparatuses forms airflow on an upper surface of a sheet to stabilize an ejection of the sheet, the airflow flowing in an ejection direction of the sheet. Another of the known image forming apparatuses blows air between two sheets, which are sequentially sent, to reduce friction between the sheets.

With regard to a post-processing apparatus for performing a given process subsequently to an image forming process by an image forming apparatus, sheets are stacked on one tray to form a stack of the sheets (sheet stack). When sheets are sent sequentially, sheets which have already stacked on the tray may be pushed in the ejection direction by a subsequent sheet. If the aforementioned conventional techniques are applied to the post-processing apparatus, air from a blower works in the ejection direction to push the sheets which have already stacked on the tray. Therefore, the aforementioned conventional techniques are not suitable to application to an ejection mechanism of the post-processing apparatus.

In addition, a frictional force caused between the sheets depends on a material of sheets and/or a condition of an image formed on the sheets. When the frictional force caused between the sheets is very large, the friction reduction effect using airflow may be insufficient. Therefore, even if a blower is placed so that air does not hit sheets which have already stacked on the tray, the sheets on the tray may be pushed by a subsequent sheet.

SUMMARY

A post-processing apparatus of the present disclosure is designed to perform a given process subsequently to an image forming process by an image forming apparatus. The post-processing apparatus includes: a first ejector which ejects a first sheet; a first tray which temporarily holds the first sheet ejected by the first ejector; a second tray situated downstream of the first tray in an ejection direction of the first sheet; a tray driver which moves the second tray downwardly from a first height position; a first blower which forms an airstream between the second tray and a lower surface of the first sheet when the first sheet is ejected by the first ejector; and a controller which controls the first blower and the tray driver. The controller includes: (i) a first blower controller which causes the first blower to blow air over a time period in synchronization with a first time period from a start to an end of an ejection of the first sheet by the first ejector; and (ii) a tray controller which causes the tray driver to move the second tray downwardly from the first height position after the first time period.

DETAILED DESCRIPTION

<Schematic Structure and Operation of Post-Processing Apparatus>

Figure 1:
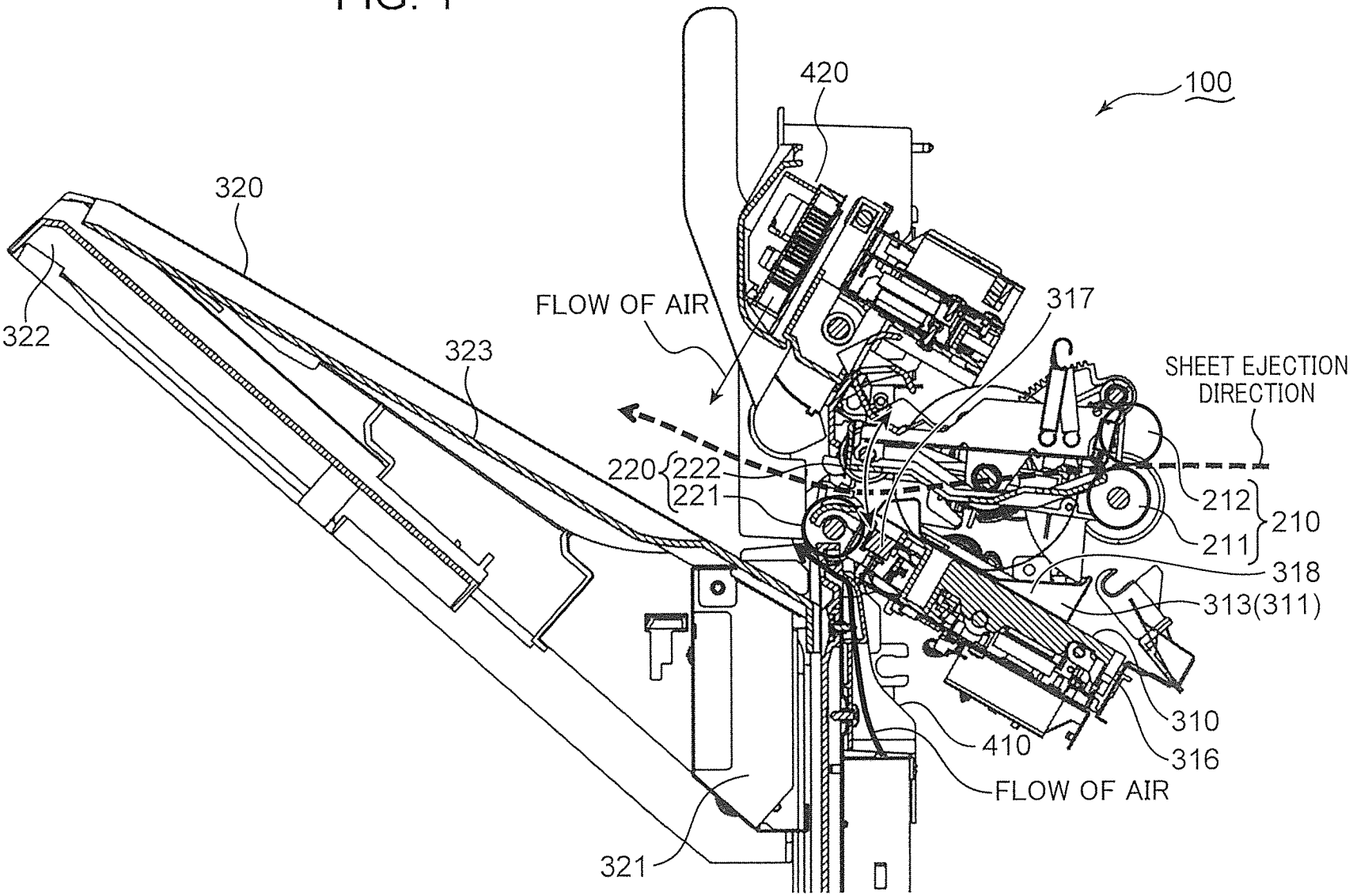
FIG. 1 is a schematic sectional view of a part of an exemplary post-processing apparatus which is used together with an image forming apparatus for forming an image.
Figure 2:
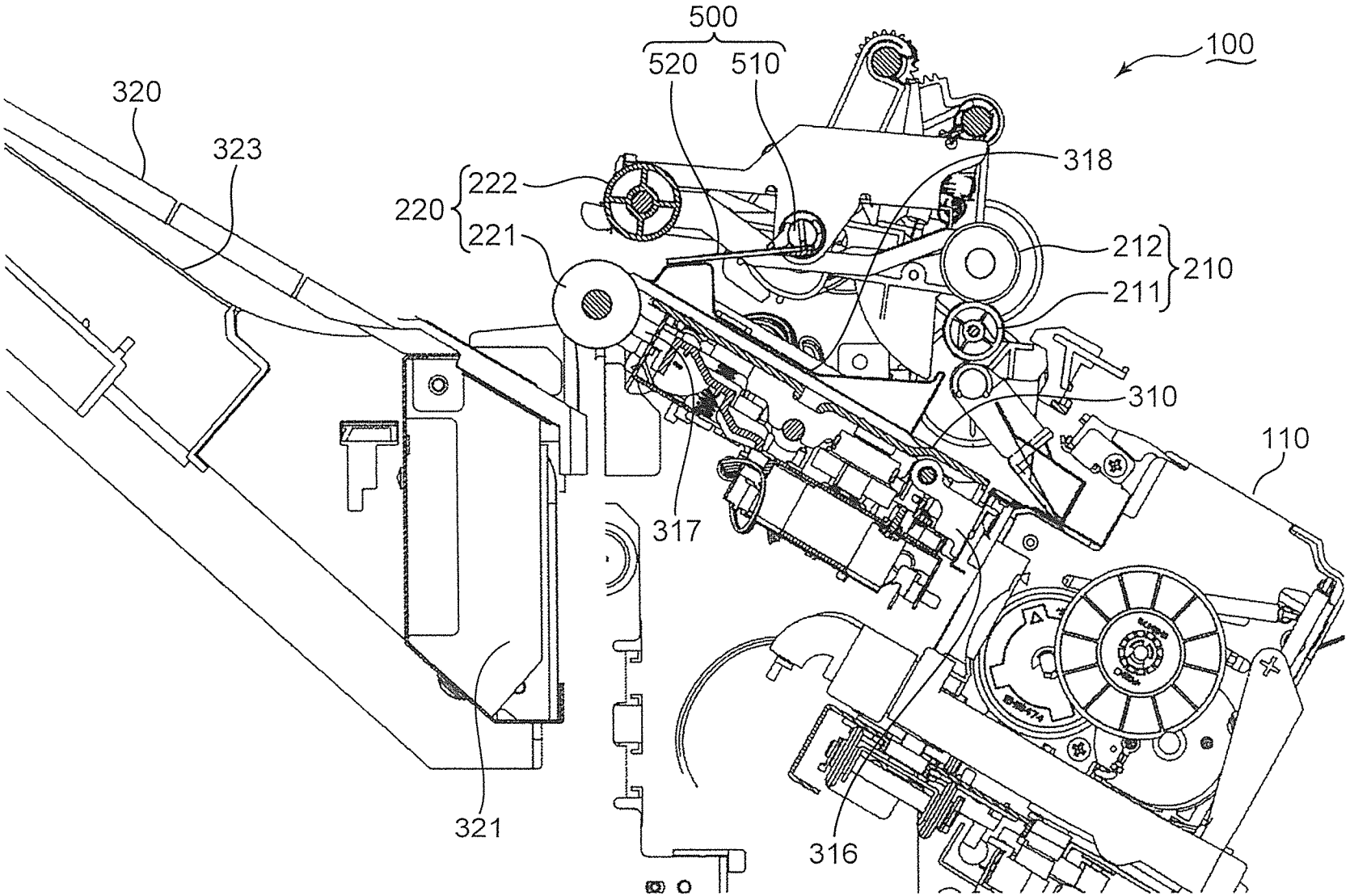
FIG. 2 is another schematic sectional view of the post-processing apparatus.

FIGS. 1 and 2 are schematic sectional views of a part of an exemplary post-processing apparatus 100 which is used together with an image forming apparatus (not shown) configured to form images. A schematic structure of the post-processing apparatus 100 is described with reference to FIGS. 1 and 2. The arrowed dotted line shown in FIG. 1 conceptually indicates a flow of a sheet in the post-processing apparatus 100. In the following description, the direction indicated by the arrowed dotted line is referred to as "ejection direction". The direction opposite to the ejection direction is referred to as "pulling-back direction".

The image forming apparatus forms an image on a sheet (image forming process). The sheet is then conveyed from the image forming apparatus to the post-processing apparatus 100. The post-processing apparatus 100 subjects the sheet to formation of a through-hole, stapling and/or folding. The principle of this embodiment is not limited by specific processes performed by the post-processing apparatus 100.

The post-processing apparatus 100 includes a part for conveying sheets, a part for supporting the conveyed sheets, a part for reducing friction which acts on the sheets under conveyance, and a part for performing a post-process. These parts are described below.

As the part for conveying sheets, the post-processing apparatus 100 is equipped with a first ejector 210, a second ejector 220 and a pulling-back mechanism 500. The first and second ejectors 210, 220 are situated on a sheet conveyance path. The first ejector 210 sends a sheet in the ejection direction. The second ejector 220 is situated downstream of the first ejector 210 in the ejection direction, and conveys a sheet in both of the ejection direction and the pulling-back direction. The pulling-back mechanism 500 is situated between the second and first ejectors 220, 210, and conveys a sheet in the pulling-back direction.

As the part for supporting sheets conveyed by the first and second ejectors 210, 220 and the pulling-back mechanism 500, the post-processing apparatus 100 is equipped with a first tray 310 situated beneath the sheet conveyance path extending from the first ejector 210 toward the second ejector 220, and a second tray 320 situated downstream of the first tray 310 in the ejection direction. The first tray 310 supports sheets conveyed in the pulling-back direction by the second ejector 200 and the pulling-back mechanism 500. The second ejector 200 and the pulling-back mechanism 500 sequentially send sheets in the pulling-back direction, so that the sheets are stacked on the first tray 310 to form a sheet stack on the first tray 310. The sheet stack on the first tray 310 is sent in the ejection direction by the second ejector 200, and supported by the second tray 320.

In order to reduce friction which acts on a part of a sheet appearing on the second tray 320, the post-processing apparatus 100 forms an airflow along a surface of the second tray 320, and/or causes the part of the sheet appearing over the second tray 320 to be curved downwardly and reduce a contact area with a subsequent sheet. The post-processing apparatus 100 is equipped with a first blower 410 for forming the airflow along the surface of the second tray 320, and a second blower 420 for causing the part of the sheet appearing over the second tray 320 to be curved downwardly. The first blower 410 is situated beneath the first tray 310, and blows air upwardly. The air which is blown upwardly forms airflow along the surface of the second tray 320. The second blower 420 is situated just above the second tray 320, and blows air toward the second tray 320. The air from the second blower 420 hits the upper surface of a part of the sheet appearing over the second tray 320, so that the air causes the part of the sheet to be curved downwardly.

Before sending the sheet stack to the second tray 320, the post-processing apparatus 100 performs a post-process for bundling the sheets on the first tray 310. The post-processing apparatus 100 is equipped with a stapler 110 for bundling sheets. The stapler 110 is situated upstream of the first tray 310 in the ejection direction.

The first ejector 210 just above the first tray 310 includes two rollers 211, 212. The roller 212 is situated above the roller 211. The rollers 211, 212 nips a sheet which arrives at the first ejector 210 via a sheet conveyance path (not shown) formed inside the post-processing apparatus 100. The roller 212 is driven by a motor (not shown). When the roller 212 is rotated by the motor, the sheet is moved in the ejection direction. The roller 211 is rotated by the movement of the sheet in the ejection direction.

The sheet sent in the ejection direction by the rollers 211, 212 reaches the second ejector 220. The second ejector 220 includes two rollers 221, 222. The roller 222 is situated above the roller 221. The roller 221 is driven by a motor (not shown). The roller 222 is displaced between an adjacent position adjacent to the roller 221, and a distant position distant from the roller 221 (the position shown in FIGS. 1 and 2). A variety of known mechanisms for displacing a position of a roller may be applied to a displacement mechanism for displacing the roller 222 between the adjacent position and the distant position. The principle of the present embodiment is not limited to a specific mechanism for displacing the roller 222 between the adjacent position and the distant position.

The roller 222 is placed at the adjacent position in order to convey a sheet (hereinafter referred to as "first sheet"), which the first ejector 210 initially supplies from the image forming apparatus to the post-processing apparatus 100. The first sheet is nipped between the rollers 221 and the roller 222 situated at the adjacent position, and conveyed in the ejection direction and the pulling-back direction. The roller 222 is placed at the distant position when at least one sheet (hereinafter referred to as "subsequent sheet") is sent from the first ejector 210 toward the second ejector 220 subsequently to the first sheet. The subsequent sheet is allowed to pass through a gap between the rollers 221, 222, so that the first ejector 210 may convey the subsequent sheet in the ejection direction without interference with the second ejector 220. When the subsequent sheet is ejected from the first ejector 210, the pulling-back mechanism 500 sends the subsequent sheet in the pulling-back direction.

The pulling-back mechanism 500 includes a rotary shaft 510 shaped as a round bar, and a paddle arm 520 extending in a tangent direction to a circumferential surface of the rotary shaft 510. The rotary shaft 510 is rotated by a motor (not shown) when the first ejector 210 completes the ejection of the subsequent sheet. When the rotary shaft 510 is rotated, the paddle arm 520 is brought into contact with an upper surface of the subsequent sheet, and elastically bent. By a frictional force between the paddle arm 520 and the upper surface of the subsequent sheet ejected from the first ejector 210, and a restoring force caused by the elastic deformation of the paddle arm 520, the subsequent sheet is moved in the pulling-back direction and placed on the first tray 310. Accordingly, the subsequent sheet is stacked on the first sheet to form a sheet stack on the first tray 310. The first tray 310 temporarily holds the sheet stack.

The sheet stack formed on the first tray 310 is stapled by the stapler 110, so that sheets of the sheet stack are bundled. The stapler 110 may have the same structure as that of a stapler incorporated into a known post-processing apparatus. The principle of the present embodiment is not limited to a specific structure of the stapler 110.

The first tray 310 situated next to the stapler 110 includes a proximal end 316 situated beneath the first ejector 210, and a distal end 317 to which the roller 221 of the second ejector 220 is attached. The proximal end 316 is situated at a height position lower than the distal end 317. Consequently, the first tray 310 forms a support surface 318 extending obliquely upwardly from the proximal end 316 toward the distal end 317. The sheet stack is supported on the support surface 318 of the first tray 310.

The second tray 320 situated downstream of the first tray 310 extends in the ejection direction from a region beneath the second ejector 220. The second tray 320 includes a proximal end 321 situated beneath the roller 221 of the second ejector 220, and a distal end 322 away from the proximal end 321 in the ejection direction. The distal end 322 is situated above the proximal end 316. Consequently, the second tray 320 forms a support surface 323 extending obliquely between the proximal end 321 and the distal end 322. The support surface 323 of the second tray 320 supports a part of the sheet stack which protrudes from the first tray 310.

Each of the first and second blowers 410, 420 blows air to a space above the second tray 320. Airflows from the first and second blowers 410, 420 are conceptually indicated by the arrowed solid lines in FIG. 1, respectively. The direction of the airflow from the second blower 420 is substantially perpendicular to the support surface 323 of the second tray 320 whereas the air from the first blower 410 is blown through a gap between the proximal end 321 of the second tray 320 and the roller 221 of the second ejector 220 to form an airflow substantially in parallel to the support surface 323 of the second tray 320. A general fan device may be used as each of the first and second blowers 410, 420. For example, an axial flow fan, a centrifugal fan, a diagonal flow fan or a cross flow fan may be used as each of the first and second blowers 410, 420. The principle of the present embodiment is not limited to a specific blower used as each of the first and second blowers 410, 420.

A schematic sheet conveyance operation of the post-processing apparatus 100 is described below.

The first sheet and the subsequent sheet are sequentially sent from the image forming apparatus to the post-processing apparatus 100. Accordingly, the first ejector 210 sequentially receives the first sheet and the subsequent sheet. The rollers 211, 212 of the first ejector 210 nip the first sheet and the subsequent sheet, and sequentially send them in the ejection direction.

When the first ejector 210 ejects the first sheet, the roller 222 of the second ejector 220 is placed at the adjacent position. Therefore, the first sheet is nipped between the rollers 221, 222. During a time period from a start to an end of the ejection of the first sheet from the first ejector 210, the roller 221 is rotated by the motor (not shown) so that the first sheet is sent in the ejection direction. Meanwhile, the roller 221 is rotated by the movement of the first sheet in the ejection direction. When the first ejector 210 completes the ejection of the first sheet, the roller 222 is rotated by the motor so that the first sheet is sent in the pulling-back direction. Meanwhile, the roller 222 is rotated by the movement of the first sheet in the pulling-back direction. As a result of conveyance of the first sheet in the pulling-back direction, the first sheet is supplied onto the first tray 310. At this moment, a part of the first sheet protrudes from the first tray 310 in the ejection direction and is supported by the second tray 320.

When the first ejector 210 ejects the subsequent sheet subsequently to the first sheet, the roller 222 of the second ejector 220 is placed at the distant position. Instead of the second ejector 220, the pulling-back mechanism 500 conveys the subsequent sheet in the pulling-back direction after the subsequent sheet has been ejected from the first ejector 210.

When the first ejector 210 completes the ejection of the subsequent sheet, the rotary shaft 510 of the pulling-back mechanism 500 is rotated by a motor (not shown). Upon the rotation of the rotary shaft 510, the paddle arm 520 is brought into contact with an upper surface of the subsequent sheet and elastically bent. By a frictional force between the paddle arm 520 and the upper surface of the subsequent sheet ejected from the first ejector 210, and a restoring force caused by the elastic deformation of the paddle arm 520, the subsequent sheet is moved in the pulling-back direction and placed on the first tray 310. Consequently, the subsequent sheet is stacked on the first sheet to form a sheet stack on the first tray 310. The sheet stack is then stapled by the stapler 110, so that the sheets in the sheet stack are bundled.

After stapler 110 stapes the sheet stack, the roller 222 of the second ejector 220 is displaced downwardly. Consequently, the sheet stack is nipped between the rollers 221, 222. Subsequently, the roller 221 is rotated by the motor so that the sheet stack is conveyed in the ejection direction. As a result of the rotation of the roller 221, the sheet stack is ejected from the first tray 310 to the second tray 320.

Schematic air-blowing operations of the first and second blowers 410, 420 of the post-processing apparatus 100 are described below.

The first blower 410 blows air from an outlet formed between the roller 221 of the second ejector 220 and the proximal end 321 of the second tray 320 when the first ejector 210 sends the first sheet in the ejection direction. Accordingly, airflow is formed between the lower surface of the first sheet and the support surface 323 of the second tray 320. Since the airflow significantly reduces a frictional force between the first sheet and the support surface 323 of the second tray 320, the first sheet may smoothly move in the ejection direction.

In synchronization with the start of the air-blow from the first blower 410, the second blower 420 situated just above the second tray 320 also blows air to the support surface 323 of the second tray 320 in a direction substantially perpendicular to the support surface 323. Accordingly, the air blown downwardly from the second blower 420 is hit against the upper surface of the first sheet.

When the first sheet is conveyed in the pulling-back direction or when the first sheet is received in the first tray 310, the first blower 410 stops blowing the air. On the other hand, the second blower 420 continues the air-blow. Accordingly, the first sheet protruding is curved downwardly above the support surface 323. The downward curvature of the first sheet protruding above the support surface 323 means that the first sheet moves away downwardly from a conveyance path of the subsequent sheet. Therefore, there is a significant reduction in contact area between the first sheet and the subsequent sheet. Accordingly, the subsequent sheet is less likely to come into close contact with the first sheet.

While the subsequent sheet is conveyed in the ejection direction by the first ejector 210 and while the subsequent sheet is conveyed in the pulling-back direction by the pulling-back mechanism 500, air is blown from the second blower 420 to the upper surface of the subsequent sheet. A volume (volumetric flow rate) of the air from the second blower 420 is set to be less than the volume (volumetric flow rate) of the air from the first blower 410. Therefore, the air blown from the second blower 420 does not excessively strongly press the subsequent sheet against the first sheet. In short, the air-blow from the second blower 420 does not cause a close contact between the subsequent sheet and the first sheet.

Figure 3:
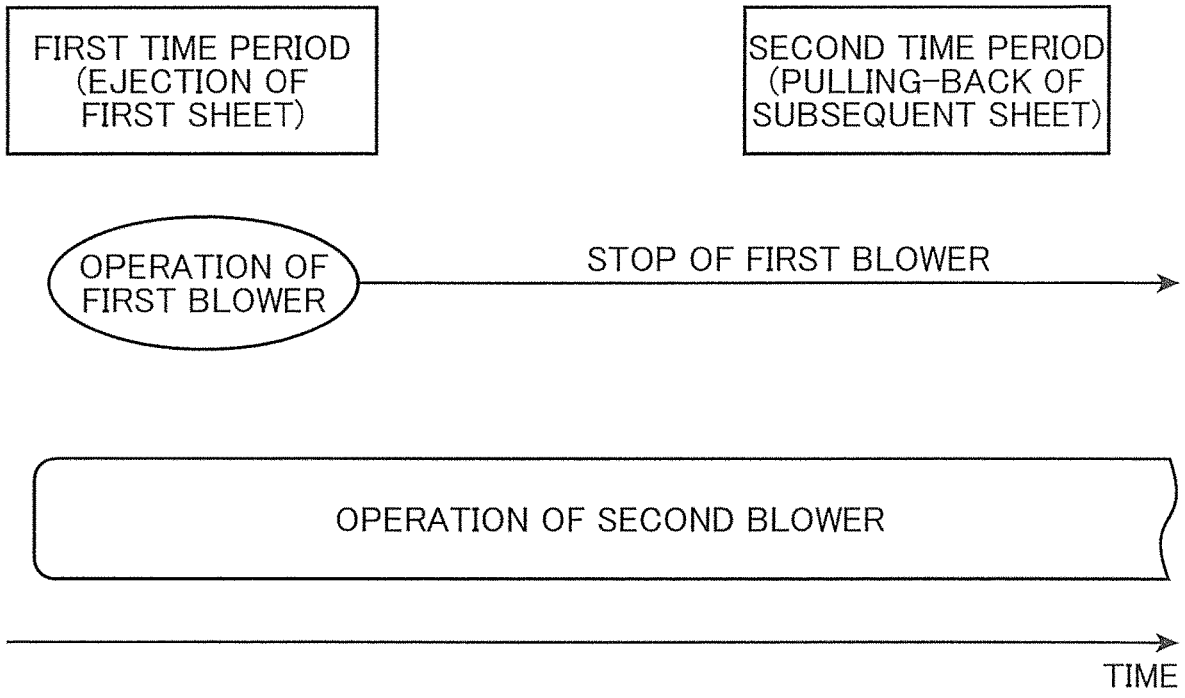
FIG. 3 is a conceptual view of operations of a first blower and a second blower of the post-processing apparatus.

FIG. 3 is a conceptual view of operations of the first and second blowers 410, 420. The operations of the first and second blowers 410, 420 are further described with reference to FIGS. 1 to 3.

FIG. 3 conceptually shows a first time period and a second time period. The first time period means a time period between a time when the first ejector 210 starts ejecting the first sheet and a time when the first ejector 210 completes the ejection of the first sheet. The second time period means a time period between a time when the pulling-back mechanism 500 starts conveying the subsequent sheet, which is ejected next to the first sheet, in the pulling-back direction and a time when the pulling-back mechanism 500 completes the conveyance of the subsequent sheet in the pulling-back direction.

During the first time period, the first blower 410 is operated so that air is blown from the first blower 410. The air-blow from the first blower 410 may be started in synchronization with the start of the first time period. Alternatively, the air-blow from the first blower 410 may be started before the start of the first time period. Alternatively, the air-blow from the first blower 410 may be started between the start and the end of the first time period. The air-blow from the first blower 410 may be completed in synchronization with the end of the first time period. Alternatively, the air-blow from the first blower 410 may be completed before the end of the first time period. Alternatively, the air-blow from the first blower 410 may be completed between the end of the first time period and the start of the second time period.

Like the first blower 410, the second blower 420 is operated during the first time period so that air is blown from the second blower 420. The air-blow from the second blower 420 may be started in synchronization with the start of the first time period. Alternatively, the air-blow from the second blower 420 may be started before the start of the first time period. Alternatively, the air-blow from the second blower 420 may be started between the start and the end of the first time period.

<Controller of Post-Processing Apparatus>

Figure 4:
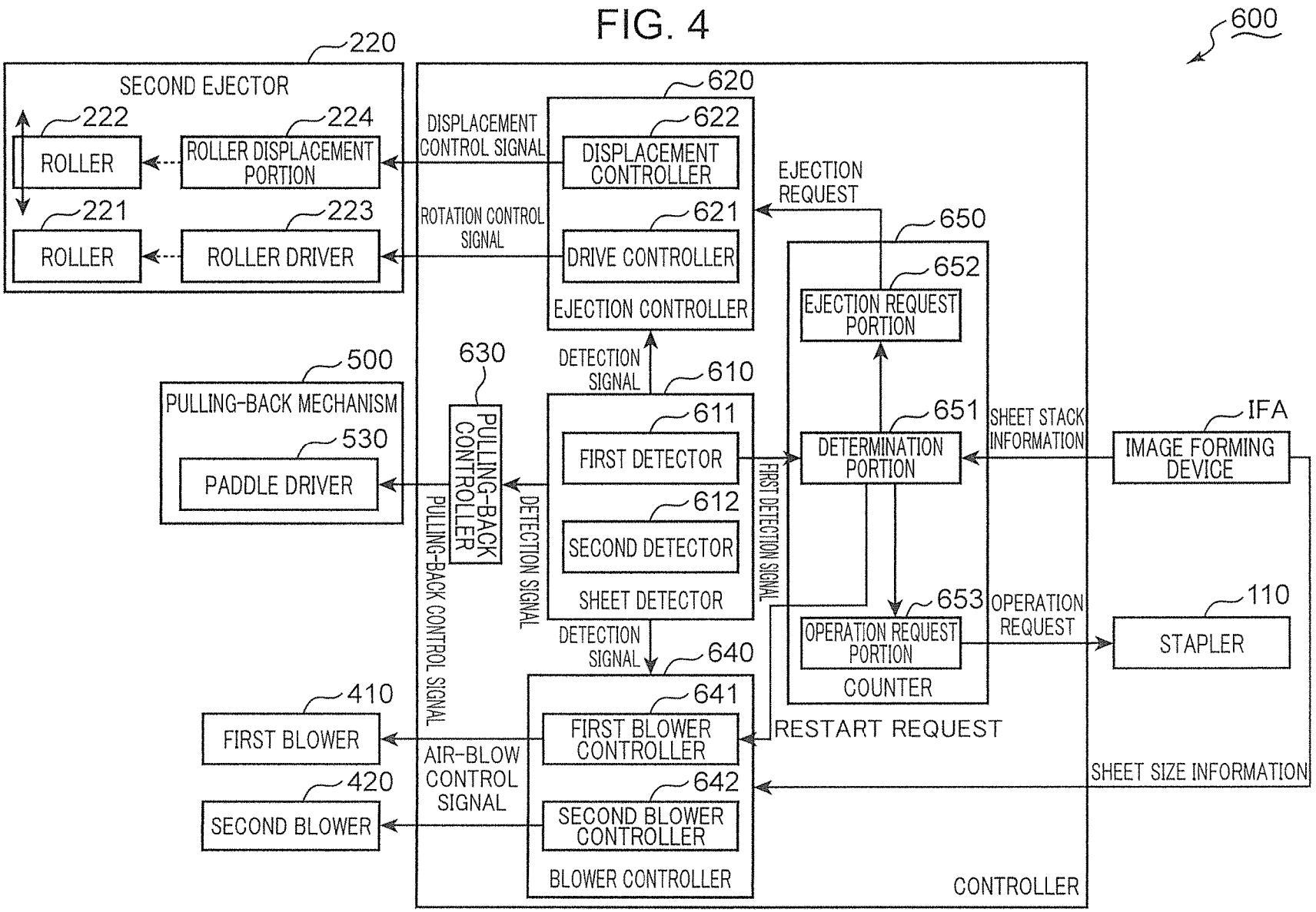
FIG. 4 is a schematic block diagram showing an exemplary functional configuration of a controller for controlling various operations of the post-processing apparatus.

FIG. 4 is a schematic block diagram showing an exemplary functional configuration of a controller 600 for controlling a variety of the aforementioned operations of the post-processing apparatus 100. The controller 600 is described with reference to FIGS. 2 and 4. The solid line in FIG. 4 conceptually indicates signal transmission. The dotted line in FIG. 4 conceptually indicates force transmission.

The controller 600 controls the second ejector 220, the pulling-back mechanism 500, the first and second blowers 410, 420. The second ejector 220 includes a roller driver 223 and a roller displacement portion 224 in addition to the rollers 221, 222. The roller driver 223 bi-directionally rotates the roller 221. The roller displacement portion 224 displaces the roller 222 between the adjacent position and the distant position. The pulling-back mechanism 500 includes a paddle driver 530, in addition to the rotary shaft 510 and the paddle arm 520. The paddle drive mechanism 530 rotates the rotary shaft 510.

The controller 600 includes a sheet detector 610, an ejection controller 620, a pulling-back controller 630, a blower controller 640 and a counter 650. The sheet detector 610 detects a sheet ejected from the first ejector 210, and a sheet on the first tray 310. The sheet detector 610 detecting the sheet generates a detection signal indicative of the detection of the sheet. The detection signal is output from the sheet detector 610 to each of the ejection controller 620, the pulling-back controller 630 and the blower controller 640. The ejection controller 620 controls the second blower 220 in response to the detection signal. The pulling-back controller 630 controls the pulling-back mechanism 500 in response to the detection signal. The blower controller 640 controls the first and second blowers 410, 420 in response to the detection signal. The counter 650 counts sheets on the basis of the detection signal to perform a given determination process. In addition, the counter 650 outputs a given operation instruction on the basis of a result of the determination process to each of the ejection controller 620, the blower controller 640 and the stapler 110.

Figure 5:
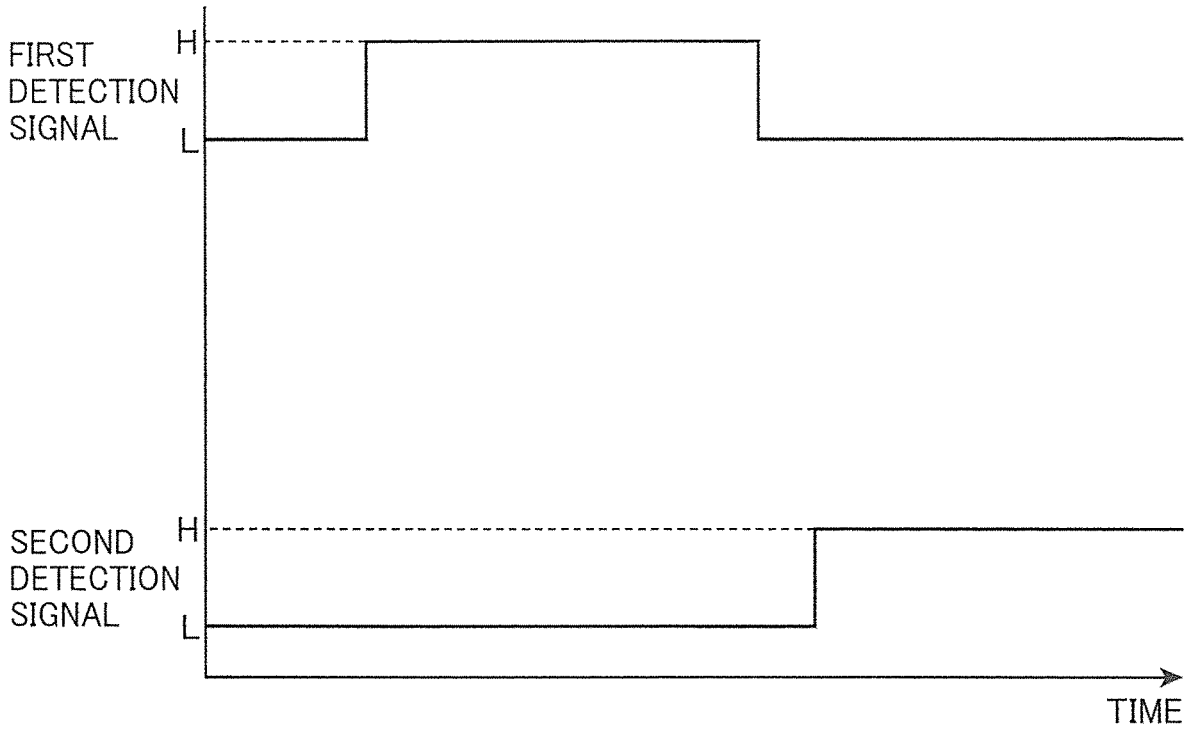
FIG. 5 is a schematic timing chart of a detection signal output from a sheet detector of the post-processing apparatus shown in FIG. 1.

FIG. 5 is a schematic timing chart of the detection signal output from the sheet detector 610. The sheet detector 610 is described with reference to FIGS. 1, 2, 4 and 5.

The sheet detector 610 includes a first detector 611 and a second detector 612. The first detector 611 detects a sheet (i.e. the first sheet or the subsequent sheet) ejected from the first ejector 210. The second detector 612 detects a sheet on the first tray 310.

The first detector 611 may be a transmissive optical sensor situated just after the first ejector 210. The first detector 611 generates a first detection signal. The first detector 611 outputs a high voltage signal as the first detection signal when a sheet blocks an optical path which is formed downstream of the first ejector 210 by the first detector 611. Otherwise, the first detector 611 outputs a low voltage signal as the first detection signal. A change from the low voltage to the high voltage indicates that a downstream end (downstream edge in the ejection direction) of a sheet blocks the optical path formed downstream of the first ejector 210. A change from the high voltage to the low voltage indicates that an upstream end (upstream edge in the ejection direction) of the sheet passes through the optical path formed downstream of the first ejector 210. The first detector 611 may be any other type of sensor as long as it is capable of detecting the start and the end of the ejection of a sheet from the first ejector 210. The principle of the present embodiment is not limited to a specific sensor used as the first detector 611.

The second detector 612 may be a reflective optical sensor attached to the first tray 310. The second detector 612 generates a second detection signal at a low voltage when there is no sheet on the first tray 310. When the first sheet is supplied onto the first tray 310, the first sheet reflects detective light emitted from the second detector 612. The second detector 612 receives the detective light reflected by the first sheet and generates the second detection signal at a high voltage. A change from the low voltage to the high voltage indicates that the first sheet is placed on the first tray 310. A change from the high voltage to the low voltage indicates that a sheet stack is ejected from the first tray 310 to the second tray 320.

The counter 650 determines how many sheets have been ejected from the first ejector 210 to form a sheet stack, on the basis of the first detection signal output from the first detector 611. The counter 650 includes a determination portion 651, an ejection request portion 652 and an operation request portion 653. The determination portion 651 performs a given determination process on the basis of the first detection signal. The ejection request portion 652 outputs an operation instruction to the ejection controller 620 on the basis of a result of the determination process of the determination portion 651. The operation request portion 653 outputs an operation instruction to the stapler 110 on the basis of a result of the determination process of the determination portion 651.

The determination portion 651 receives the first detection signal (c.f. FIG. 4) from the first detector 611. The determination portion 651 counts pulses of the first detection signal to generate a count value. The count value is indicative of how many sheets have passed through the first ejector 210. The determination portion 651 also receives sheet stack information from the image forming apparatus IFA, in addition to the first signal. The sheet stack information is indicative of the total number of sheets which have been supplied from the image forming apparatus IFA to the post-processing apparatus 100. The counter 650 compares the count value with the total sheet number indicated by the sheet stack information.

The ejection request portion 652 generates an ejection request in response to a result of the comparison between the count value and the total sheet number. The ejection request is output from the ejection request portion 652 to the ejection controller 620. The ejection controller 620 controls the second ejector 220 in response to the ejection request. The second ejector 220 ejects the sheet stack from the first tray 310 to the second tray 320 under control of the ejection controller 620.

Before ejecting the sheet stack from the first tray 310 to the second tray 320, the operation request portion 653 generates an operation request in response to the result of the comparison between the count value and the total sheet number. The operation request is output from the operation request portion 653 to the stapler 110. In response to the operation request, the stapler 110 is operated to staple the sheet stack.

Figure 6:
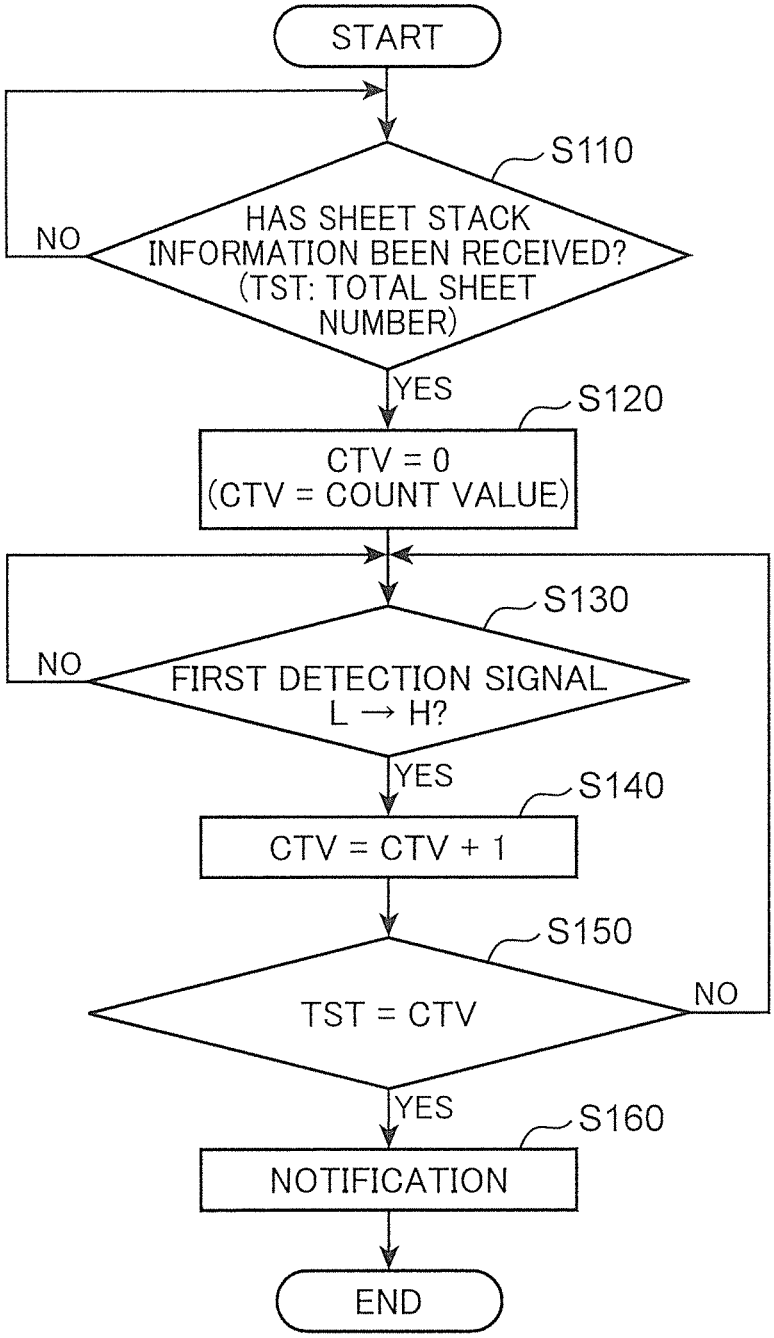
FIG. 6 is a schematic flowchart showing an operation of a determination portion of the controller.

FIG. 6 is a schematic flowchart showing operations of the determination portion 651 to notify a determination result to the operation request portion 653 and the ejection request portion 652 which generate the operation request and the ejection request, respectively. The operations of the determination portion 651 are described below with reference to FIGS. 4 and 6.

(Step S110)

The determination portion 651 waits for the sheet stack information. Once the determination portion 651 receives the sheet stack information from the image forming apparatus IFA, step S120 is executed.

(Step S120)

The determination portion 651 sets the count value to "0". Step S130 is then executed.

(Step S130)

The determination portion 651 refers to the first detection signal, and waits for a change from a low voltage level to a high voltage level in the first detection signal. When there is the change from the low voltage level to the high voltage level, step S140 is executed.

(Step S140)

The determination portion 651 adds "1" to the count value. Step S150 is then executed.

(Step S150)

The determination portion 651 compares the count value with the total sheet number indicated by the sheet stack information, to determine whether or not the counter value is coincident with the total sheet number. A sheet in correspondence to a count value which is coincident with the total sheet number is a second sheet which is the last sheet ejected from the first ejector 210 in a sheet stack. When the count value becomes coincident with the total sheet number, step S160 is executed. Otherwise, the step S130 is executed.

(Step S160)

It is notified from the determination portion 651 to each of the ejection request portion 652 and the operation request portion 653 that the count value becomes coincident with the total sheet value. The ejection request portion 652 generates an ejection request in response to the notification from the determination portion 651. The ejection request is output from the ejection request portion 652 to the ejection controller 620. The ejection controller 620 controls the second ejector 220 in response to the ejection request. Under control of the ejection controller 620, the second ejector 220 ejects a sheet stack from the first tray 310 to the second tray 320. Like the ejection request portion 652, the operation request portion 653 receiving the notification from the determination portion 651 generates an operation request in response to the notification from the determination portion 651. The operation request is output from the operation request portion 653 to the stapler 110. In response to the operation request, the stapler 110 is operated to staple the sheet stack. These output timings of the ejection request and the operation request are adjusted in the counter 650 so that the operation request is output before the ejection request. Therefore, the second ejector 220 may perform an ejection operation under control of the ejection controller 620 after the stapler 110 stapling the sheet stack.

The ejection controller 620 receives not only the ejection request from the counter 650 but also the detection signal from the sheet detector 610. The ejection controller 620 includes a drive controller 621 for controlling the roller driver 223 in response to the detection signal and the ejection request, and a displacement controller 622 for controlling the roller displacement portion 224 in response to the detection signal and the ejection request. Operations of the drive controller 621 and the displacement controller 622 are described below with reference to FIGS. 7 and 8.

Figure 7:
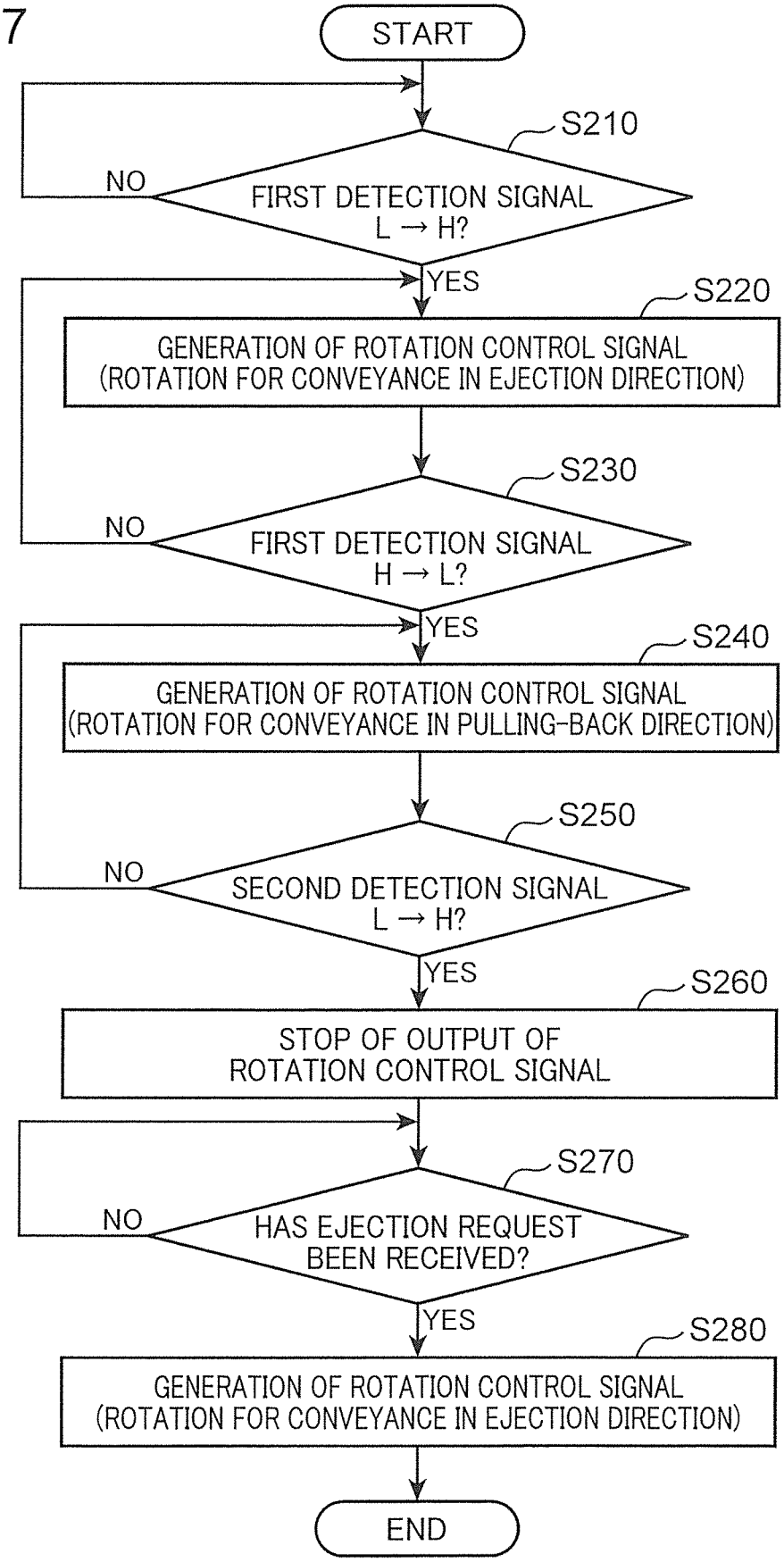
FIG. 7 is a schematic flowchart showing an operation of a drive controller of the controller.

FIG. 7 is a schematic flowchart showing operations of the drive controller 621. The operations of the drive controller 621 are described with reference to FIGS. 1, 4, 6 and 7.

(Step S210)

The drive controller 621 refers to the first detection signal output from the first detector 611, and waits for a change from the low voltage level to the high voltage level in the first detection signal. The change from the low voltage level to the high voltage level means that the first ejector 210 starts the ejection of the first sheet. When there is the change from the low voltage level to the high voltage level, step S220 is executed.

(Step S220)

The drive controller 621 generates a rotation control signal for requesting that the roller 221 is rotated so that the first sheet is moved in the ejection direction. The rotation control signal is output from the drive controller 621 to the roller driver 223. The roller driver 223 rotates the roller 221 in response to the rotation control signal. Accordingly, the first sheet is conveyed in the ejection direction. After the generation of the rotation control signal, step S230 is executed.

(Step S230)

The drive controller 621 refers to the first detection signal to determine whether or not the high voltage level in the first detection signal has changed to the low voltage level. The change from the high voltage level to the low voltage level means that the first ejector 210 completes the ejection of the first sheet. If it is determined that the high voltage level has changed to the low voltage level, step S240 is executed. Otherwise, the step S220 is executed.

(Step S240)

The drive controller 621 generates a rotation control signal for requesting that the roller 221 is rotated so that the first sheet is moved in the pulling-back direction. The rotation control signal is output from the drive controller 621 to the roller driver 223. The roller driver 223 rotates the roller 221 in response to the rotation control signal. Accordingly, the first sheet is conveyed in the pulling-back direction. After the generation of the rotation control signal, step S250 is executed.

(Step S250)

The drive controller 621 refers to the second detection signal output from the second detector 612 to determine whether or not the low voltage level in the second detection signal has changed to the high voltage level. The change from the low voltage level to the high voltage level means that the first sheet is set in position on the first tray 310. If it is determined that the low voltage level has changed to the high voltage level, step S260 is executed. Otherwise, the step S240 is executed.

(Step S260)

The drive controller 621 stops outputting the rotation control signal. Consequently, the roller driver 223 stops the roller 221. After the stop of the output of the rotation control signal, step S270 is executed.

(Step S270)

The drive controller 621 waits for the ejection request. As described with reference to FIG. 6, the ejection request is generated when the second sheet (i.e. the last sheet in the sheet stack) is ejected from the first ejector 210. When the drive controller 621 receives the ejection request from the ejection request portion 652, step S280 is executed.

(Step S280)

The drive controller 621 generates a rotation control signal for requesting a rotation of the roller 221 so that the sheet stack is moved in the ejection direction. The rotation control signal is output from the drive controller 621 to the roller driver 223 for a given time period. The roller driver 223 rotates the roller 221 in response to the rotation control signal for the given time period. Accordingly, the sheet stack is conveyed in the ejection direction, and ejected from the first tray 310 to the second tray 320.

Figure 8:
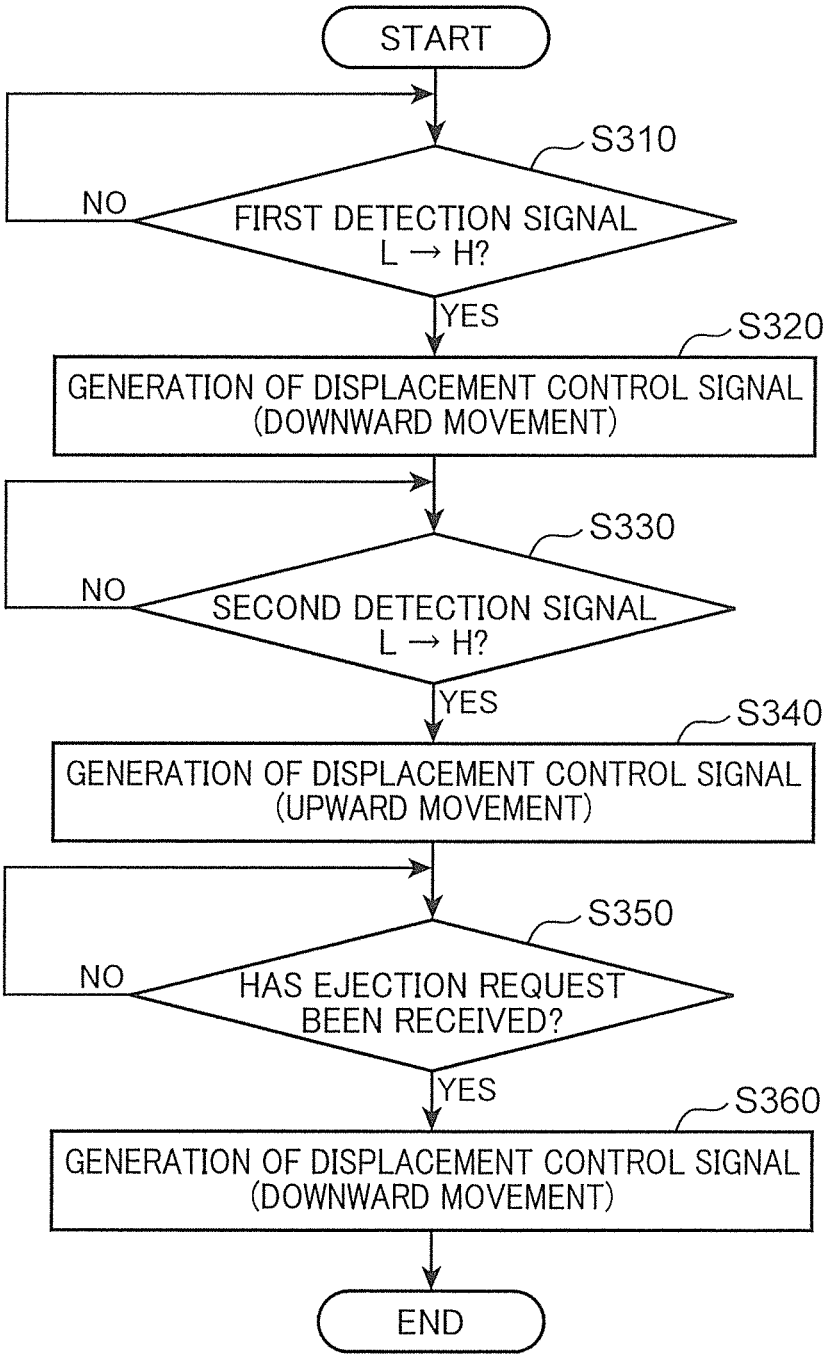
FIG. 8 is a schematic flowchart showing an operation of a displacement controller of the controller.

FIG. 8 is a schematic flowchart showing operations of the displacement controller 622. The operations of the displacement controller 622 are described with reference to FIGS. 1, 4, 6 and 8.

(Step S310)

The displacement controller 622 refers to the first detection signal output from the first detector 611, and waits for a change from the low voltage level to the high voltage level in the first detection signal. The change from the low voltage level to the high voltage level means that the first ejector 210 starts the ejection of the first sheet. When there is the change from the low voltage level to the high voltage level, step S320 is executed.

(Step S320)

The displacement controller 622 generates a displacement control signal for requesting a downward movement of the roller 222 of the second ejector 220. The displacement control signal is output from the displacement controller 622 to the roller displacement portion 224. The roller displacement portion 224 moves the roller 222 downwardly in response to the displacement control signal. Accordingly, the first sheet is nipped between the rollers 221, 222 of the second ejector 220. Therefore, the rotation of the roller 221 is efficiently transmitted to the first sheet. After the generation of the displacement control signal, step S330 is executed.

(Step S330)

The displacement controller 622 refers to the second detection signal output from the second detector 612, and waits for a change from the low voltage level to the high voltage level in the second detection signal. The change from the low voltage level to the high voltage level means that the first sheet is set in position on the first tray 310. When there is the change from the low voltage level to the high voltage level, step S340 is executed.

(Step S340)

The displacement controller 622 generates a displacement control signal for requesting an upward movement of the roller 222. The displacement control signal is output from the displacement controller 622 to the roller displacement portion 224. The roller displacement portion 224 moves the roller 222 upwardly in response to the displacement control signal. Accordingly, the roller 222 is moved upwardly away from the roller 221. After the generation of the displacement control signal, step S350 is executed.

(Step S350)

The displacement controller 622 waits for the ejection request. As described with reference to FIG. 6, the ejection request is generated when the second sheet (i.e. the last sheet in a sheet stack) is ejected from the first ejector 210. While the displacement controller 622 waits for the ejection request, the subsequent sheet sent from the first ejector 210 in the ejection direction may be moved in the ejection direction through the gap formed between the rollers 221, 222, the gap resulting from the upward movement of the roller 222. In addition, the subsequent sheet ejected from the first ejector 210 is conveyed in the pulling-back direction by the pulling-back mechanism 500 through the gap between the rollers 221, 222. Accordingly, sheets are stacked on the first tray 310 to form a sheet stack. The sheet stack partially protrudes from the second ejector 220 in the ejection direction through the gap between the rollers 221, 222. When the displacement controller 622 receives the ejection request from the ejection request portion 652, step S360 is executed.

(Step S360)

The displacement controller 622 generates the displacement control signal for requesting the downward movement of the roller 222. The displacement control signal is output from the displacement controller 622 to the roller displacement portion 224. The roller displacement portion 224 moves the roller 222 downwardly in response to the displacement control signal. Accordingly, the sheet stack is nipped between the rollers 221, 222. Therefore, the rotation of the roller 221 is efficiently transmitted to the sheet stack.

The second ejector 220 controlled by the displacement controller 622 and the drive controller 621 conveys the first sheet in the pulling-back direction whereas the pulling-back mechanism 500 conveys the subsequent sheet in the pulling-back direction after the subsequent sheet has been ejected from the first ejector 210 subsequently to the first sheet. Operations of the pulling-back controller 630 for controlling the pulling-back mechanism 500 are described below.

Figure 9:
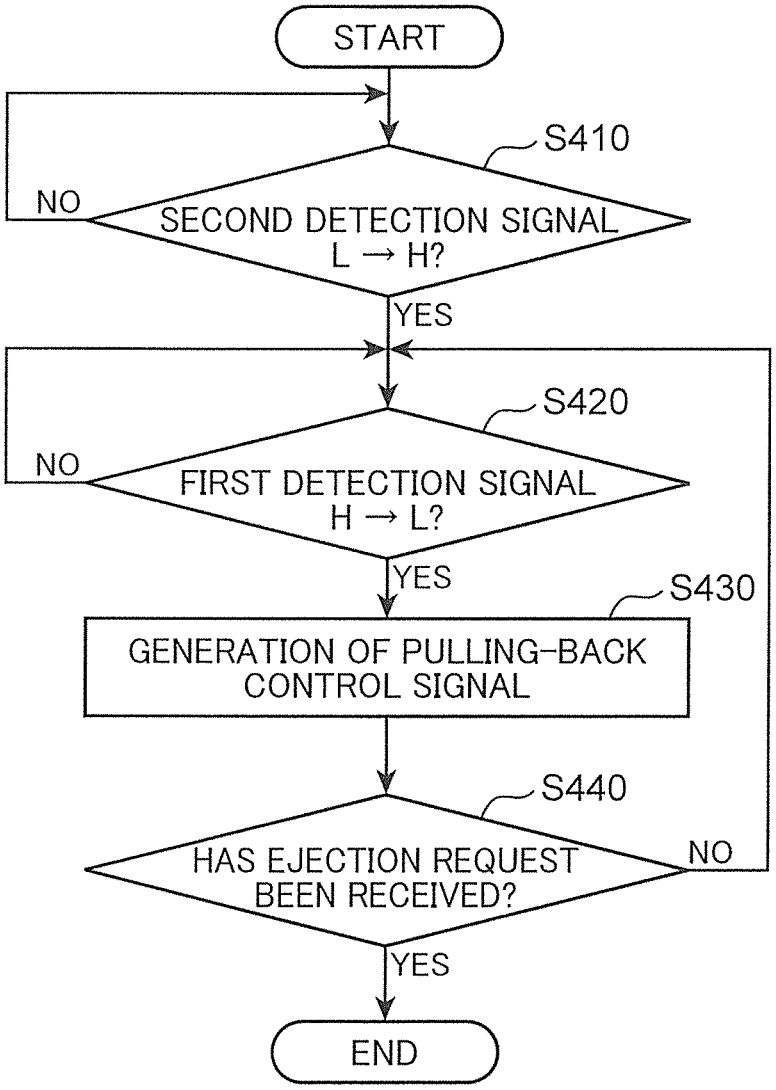
FIG. 9 is a schematic flowchart showing an operation of a pulling-back controller of the controller.

FIG. 9 is a schematic flowchart showing the operations of the pulling-back controller 630. The operations of the pulling-back controller 630 are described with reference to FIGS. 2, 4, 6 and 9.

(Step S410)

The displacement controller 630 refers to the second detection signal output from the second detector 612, and waits for a change from the low voltage level to the high voltage level in the second detection signal. The change from the low voltage level to the high voltage level means that the first sheet is set in position on the first tray 310. When there is the change from the low voltage level to the high voltage level, step S420 is executed.

(Step S420)

The pulling-back controller 630 refers to the first detection signal output from the first detector 611 to determine whether or not the high voltage level in the first detection signal has changed to the low voltage level. The change from the high voltage level to the low voltage level means that the first ejector 210 has completed the ejection of the first sheet. If it is determined that the high voltage level has changed to the low voltage level, step S430 is executed.

(Step S430)

The pulling-back controller 630 generates a pulling-back control signal for a given time period. The pulling-back control signal is output from the pulling-back controller 630 to the paddle driver 530. The paddle driver 530 rotates the rotary shaft 510 in response to the pulling-back control signal for the given time period. Accordingly, the paddle arm 520 sends the subsequent sheet in the pulling-back direction for the given time period, so that the subsequent sheet is supplied onto the first tray 310. After the generation of the pulling-back control signal by the pulling-back controller 630 for the given time period, step S440 is executed.

(Step S440)

The pulling-back controller 630 determines whether or not the ejection signal has been received. As described with reference to FIG. 6, the ejection request is generated when the second sheet (i.e. the last sheet in a sheet stack) is ejected from the first ejector 210. When the pulling-back controller 630 receives the ejection request from the ejection request portion 652, the processes of the pulling-back controller 630 is terminated. Otherwise, the step S420 is executed.

While the pulling-back controller 630 and the ejection controller 620 control the sheet conveyance operation, the blower controller 640 controls the first and second blowers 410, 420. Operations of the blower controller 640 are described below.

Figure 10:
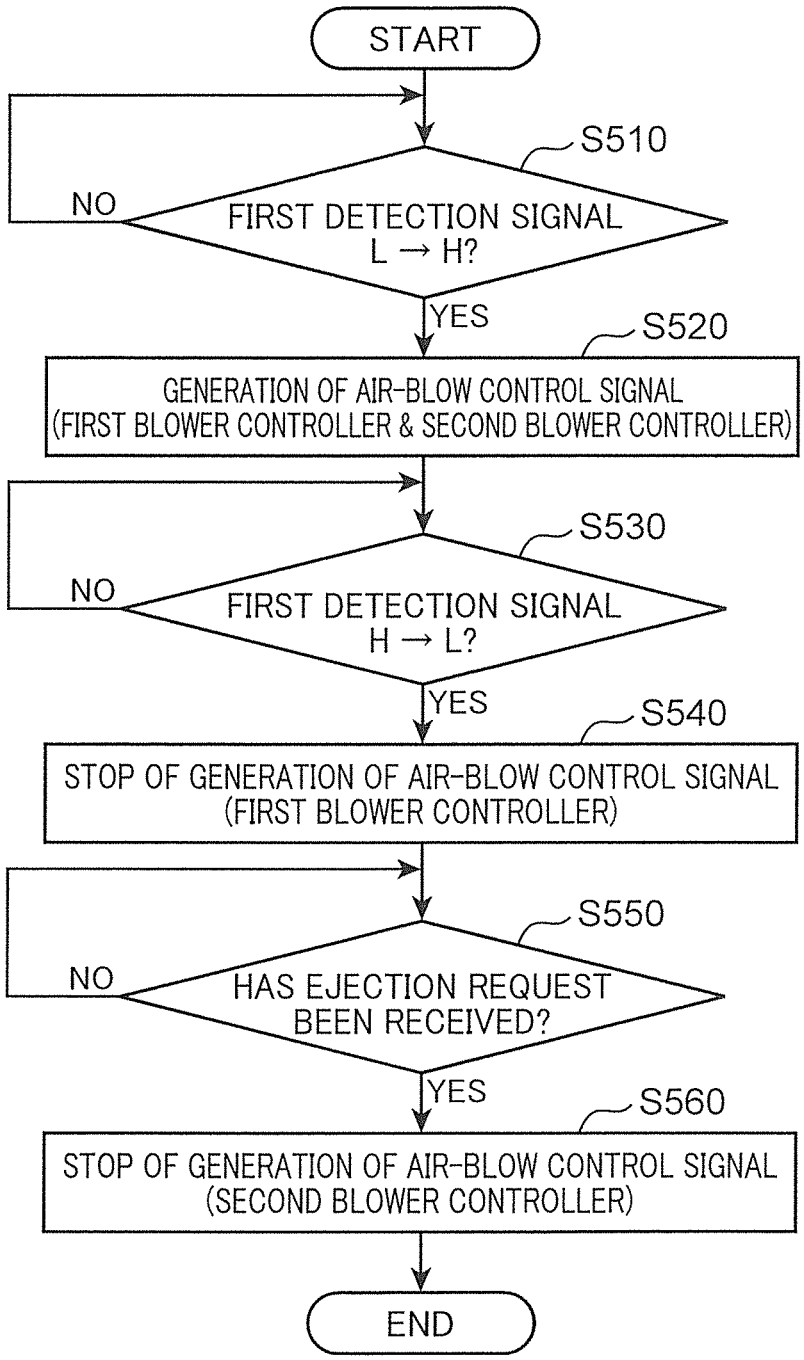
FIG. 10 is a schematic flowchart showing an operation of a blower controller of the controller.

FIG. 10 is a schematic flowchart showing the operations of the blower controller 640. The operations of the blower controller 640 are described with reference to FIGS. 1, 4, 6 and 10.

As shown in FIG. 4, the blower controller 640 includes a first blower controller 641 and a second blower controller 642. The first blower controller 641 controls the first blower 410 in response to a detection signal from the sheet detector 610. The second blower controller 642 controls the second blower 420 in response to a detection signal from the sheet detector 610. Control operations of the first and second blower controllers 641, 642 are described below with reference to FIG. 10.

(Step S510)

The blower controller 640 refers to the first detection signal, and waits for a change from the low voltage level to the high voltage level in the first detection signal. The change from the low voltage level to the high voltage level means that the first ejector 210 starts the ejection of the first sheet. When there is the change from the low voltage level to the high voltage level, step S520 is executed.

(Step S520)

Each of the first and second blower controllers 641, 642 generates an air-blow control signal. The air-blow control signal is output from the first and second blower controllers 641, 642 to the first and second blowers 410, 420, respectively. Each of the first and second blowers 410, 420 blows air in response to the air-blow control signal. The air-blow from the first blower 410 causes airflow between the lower surface of the first sheet and the support surface 323 of the second tray 320. Accordingly, there is a significant reduction in frictional force between the first sheet and the second tray 320. Therefore, the first sheet may be smoothly moved in the ejection direction. Meanwhile, the second blower 420 continues the air-blow onto the first sheet, so that a curvature deformation of the first sheet is facilitated. Consequently, the first sheet over the second tray 320 moves away from an ejection path of the subsequent sheet. Therefore, the subsequent sheet becomes less likely to come into close contact with the preceding sheet. After the generation of the air-blow control signal, step S530 is executed.

(Step S530)

The first blower controller 641 refers to the first detection signal, and waits for a change from the high voltage level to the low voltage level in the first detection signal. The change from the high voltage level to the low voltage level means that the first ejector 210 has completed the ejection of the subsequent sheet. When the high voltage level has changed to the low voltage level, step S540 is executed.

(Step S540)

The first blower controller 641 stops generating the air-blow control signal. Accordingly, the first blower 410 stops blowing the air. On the other hand, the second blower controller 642 continues to generate the air-blow control signal, so that the second blower 420 continues the air-blow. Therefore, the first sheet is curved downwardly over the second tray 320. Therefore, there is no excessively strong sliding friction between the first sheet and the subsequent sheet. After the stop of the generation of the air-blow control signal, step S550 is executed.

(Step S550)

The second blower controller 642 waits for the ejection request. The ejection request is generated when the second sheet (i.e. the last sheet in a sheet stack) is ejected from the first ejector 210. When the second blower controller 642 receives the ejection request from the ejection request portion 652, step S560 is executed.

(Step S560)

The second blower controller 642 stops generating the air-blow control signal. Accordingly, the second blower 420 stops blowing the air.

The aforementioned step S530 may be replaced by any other suitable determination processes. For example, the first blower controller 641 may refer to the second detection signal to determine whether or not the low voltage level in the second detection signal has changed to the high voltage level. The change from the low voltage level to the high voltage level means that the first sheet is set in position on the first tray 310. If it is determined that the low voltage level has changed to the high voltage level, the step S540 may be executed.

<Restart of Air-Blow from First Blower>

In regard to the control described with reference to FIG. 10, the air-blow from the first blower 410 (c.f. FIG. 1) is stopped in the step S540. However, the first blower 410 may be activated after elapse of the second time period shown in FIG. 3 to restart the air-blow from the first blower 410. By restarting the air-blow from the first blower 410, the first sheet pressed against the second tray 320 (c.f. FIG. 1) by the weight of subsequent sheets stacked on the first sheet becomes less likely to come into close contact with the second tray 320. Operations of restarting the air-blow from the first blower 410 are controlled by the determination portion 651 of the counter 650 and the first blower controller 641 of the blower controller 640. Processes which are executed by the determination portion 651 and the first blower controller 641 so as to restart the air-blow from the first blower 410 are described below with reference to FIGS. 11 and 12.

Figure 11:
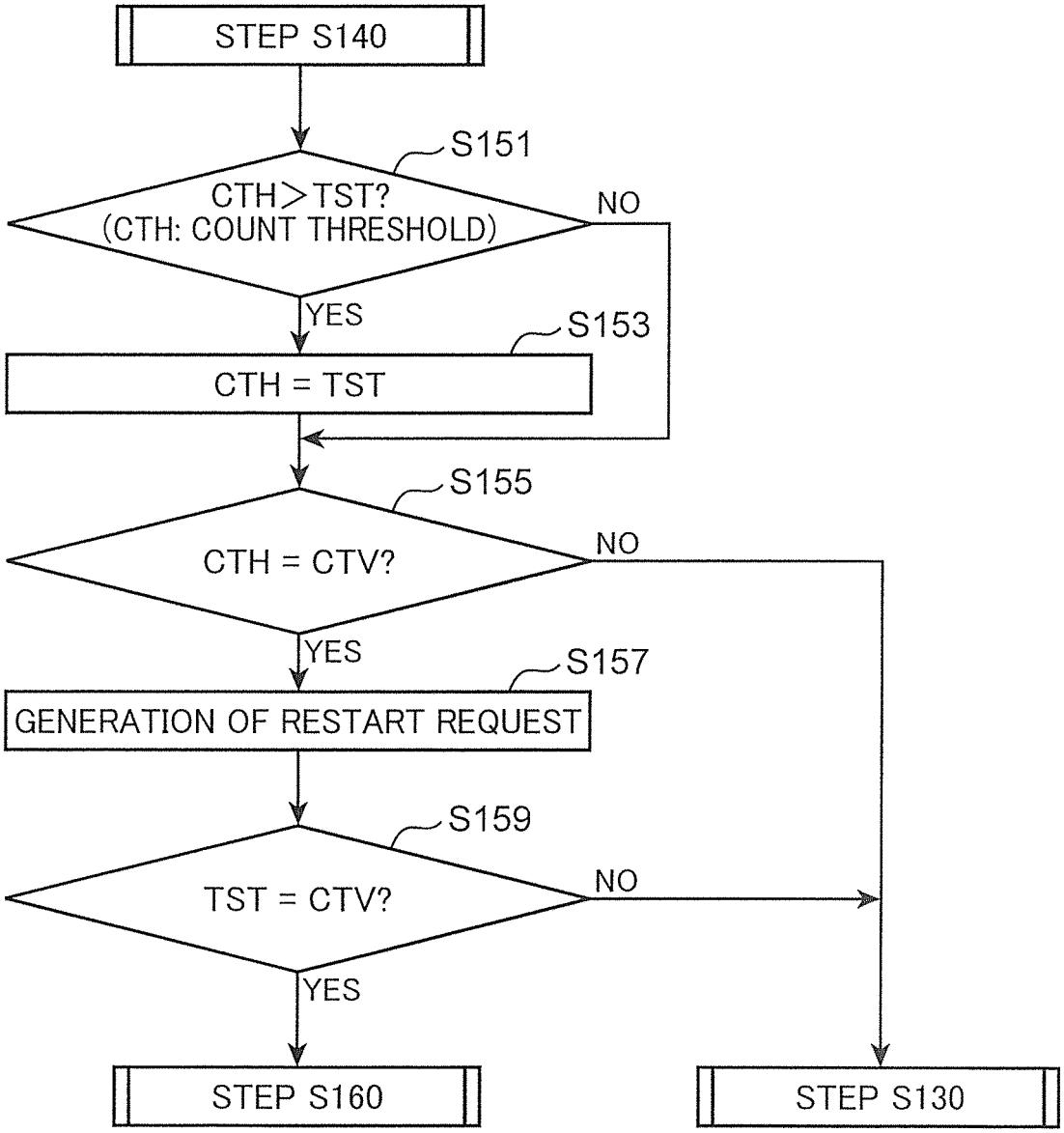
FIG. 11 is a schematic flowchart showing processes which are executed by the determination portion of a counter of the controller.

FIG. 11 is a schematic flowchart showing the processes which are executed by the determination portion 651 of the counter 650. The operations of the determination portion 651 are described with reference to FIGS. 4, 6 and 11.

(Step S151)

The processes for restarting the air-blow from the first blower 410 may be performed in the step S150 described with reference to FIG. 6. Therefore, step S151 is performed just after the step S140. The determination portion 651 compares the total sheet number indicated by the sheet stack information with a given count threshold. If the total sheet number is less than the given count threshold, step S153 is executed. Otherwise, step S155 is executed.

(Step S153)

The determination portion 651 sets the count threshold to a value of the total sheet number. Subsequently, the step S155 is executed.

(Step S155)

The determination portion 651 compares the count value with the count threshold. If the count value is coincident with the count threshold, step S157 is executed. Otherwise, the step S130 is executed.

(Step S157)

The determination portion 651 generates a restart request. The restart request is output from the determination portion 651 to the first blower controller 641. After the generation of the restart request, step S159 is executed.

(Step S159)

The determination portion 651 compares the count value with the total sheet number indicated by the sheet stack information. When the count value is coincident with the total sheet number, the step S160 is executed. Otherwise, the step S130 is executed.

Figure 12:
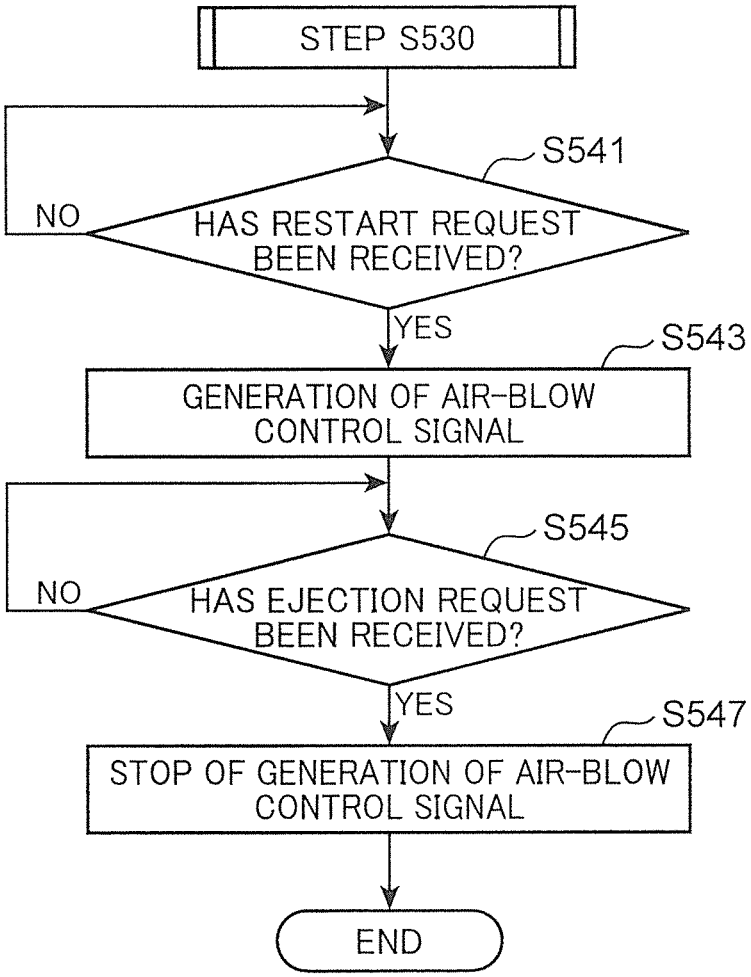
FIG. 12 is a schematic flowchart showing processes which are executed by a first blower controller of the blower controller.

FIG. 12 is a schematic flowchart showing processes of the first blower controller 641. The processes of the first blower controller 641 are described with reference to FIGS. 4, 6, and 10 to 12.

(Step S541)

The processes for restarting the air-blow from the first blower 410 may be performed in the step S540 described with reference to FIG. 10. Therefore, step S541 is performed just after the step S530. The first blower controller 641 waits for the restart request generated in the step S157 of FIG. 11. When the first blower controller 641 receives the restart request from the determination portion 651, step S543 is executed.

(Step S543)

The first blower controller 641 generates an air-blow control signal. The air-blow control signal is output from the first blower controller 641 to the first blower 410. The first blower 410 restarts the air-blow in response to the air-blow control signal. Air from the first blower 410 is blown into a boundary between the lower surface of the first sheet and the support surface 323 of the second tray 320. Accordingly, the first sheet becomes less likely to come into close contact with the second tray 320. After the generation of the air-blow control signal, step S545 is executed.

(Step S545)

The first blower controller 641 waits for the ejection request. As described with reference to FIG. 6, the ejection request is generated when the second sheet (i.e. the last sheet in a sheet stack) is ejected from the first ejector 210. When the first blower controller 641 receives the ejection request from the ejection request portion 652, step S547 is executed.

(Step S547)

The first blower controller 641 stops generating the air-blow control signal. Accordingly, the first blower 410 stops the air-blow.

(Control According to Sheet Size)

If a sheet is short in the ejection direction, a contact area between the first sheet and the subsequent sheet does not become too large. Therefore, the first sheet is less likely to interfere with pulling-back of the subsequent sheet. In this case, the air-blow from the first and second blowers 410, 420 results in wasting electric power of the post-processing apparatus 100. An exemplary control depending on a sheet size is described below.

As shown in FIG. 4, sheet size information indicative of a sheet length in the ejection direction may be output from the image forming apparatus IFA to the blower controller 640. For example, the sheet size information may include "A4 size", and "lateral orientation (i.e. a short side of the first sheet is oriented substantially in parallel to the ejection direction)". The blower controller 640 refers to the sheet size information to determine whether or not the air-blow from the first and second blowers 410, 420 should be performed.

Figure 13:
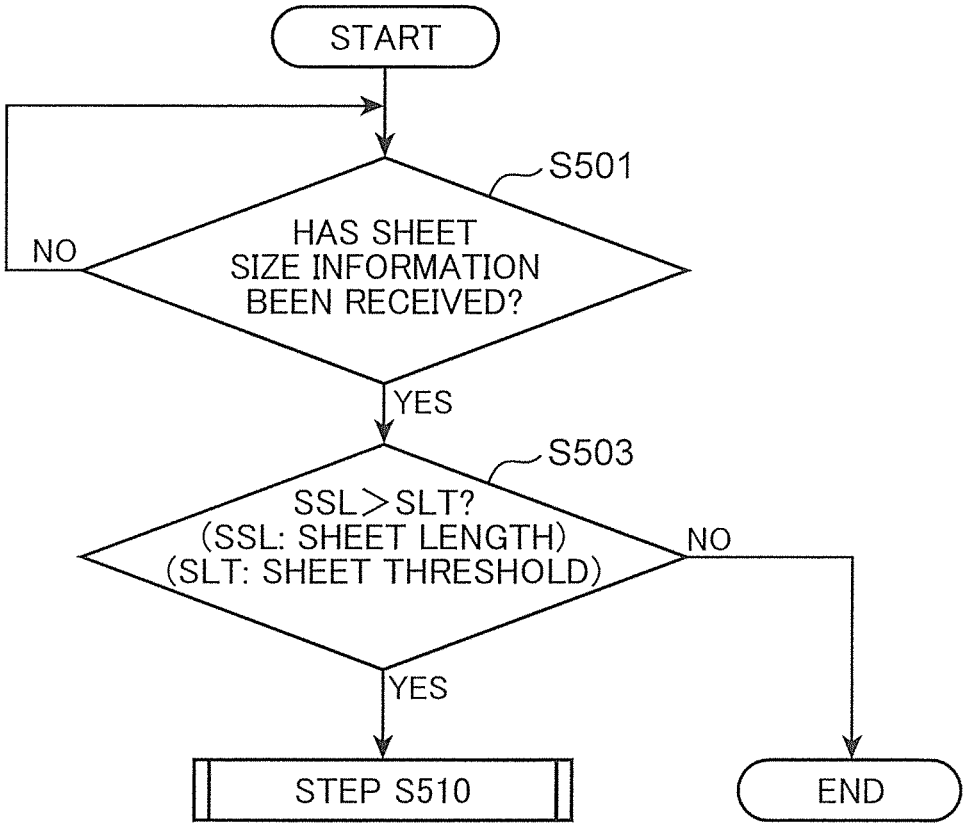
FIG. 13 is a schematic flowchart showing an exemplary process, which is executed by the blower controller to determine whether air should be blown or not.

FIG. 13 is a schematic flowchart showing exemplary processes which are executed by the blower controller 640 so as to determine whether or not the air-blow should be performed. The exemplary processes of the blower controller 640 are described with reference to FIGS. 4, 10 and 13.

(Step S501)

The blower controller 640 waits for the sheet size information. When the blower controller 640 receives the sheet size information, step S503 is executed.

(Step S503)

The blower controller 640 refers to the sheet size information to identify the sheet length in the ejection direction. The blower controller 640 compares the sheet length with a given length threshold. If the sheet length is greater than the length threshold, the step S510 is executed. Accordingly, the series of processes described with reference to FIG. 10 is executed. On the other hand, if the sheet length is not greater than the length threshold, the blower controller 640 terminates the processes. In this case, the first and second blowers 410, 420 do not blow air.

The length threshold may be set so that the step S510 is executed when a sheet area more than one-half of the entire surface protrudes from the first tray 310. However, the principle of the present embodiment is not limited to a specific value of the length threshold. According to the processing flow shown in FIG. 13, when the sheet length is not greater than the length threshold, the first and second blowers 410, 420 are stopped. However, the first and second blowers 410, 420 may blow air, irrespective of the sheet length.

<Drive of Second Tray>

The post-processing apparatus 100 is designed so that the second tray 320 is moved vertically. The drive of the second tray 320 is described below.

Figure 14:
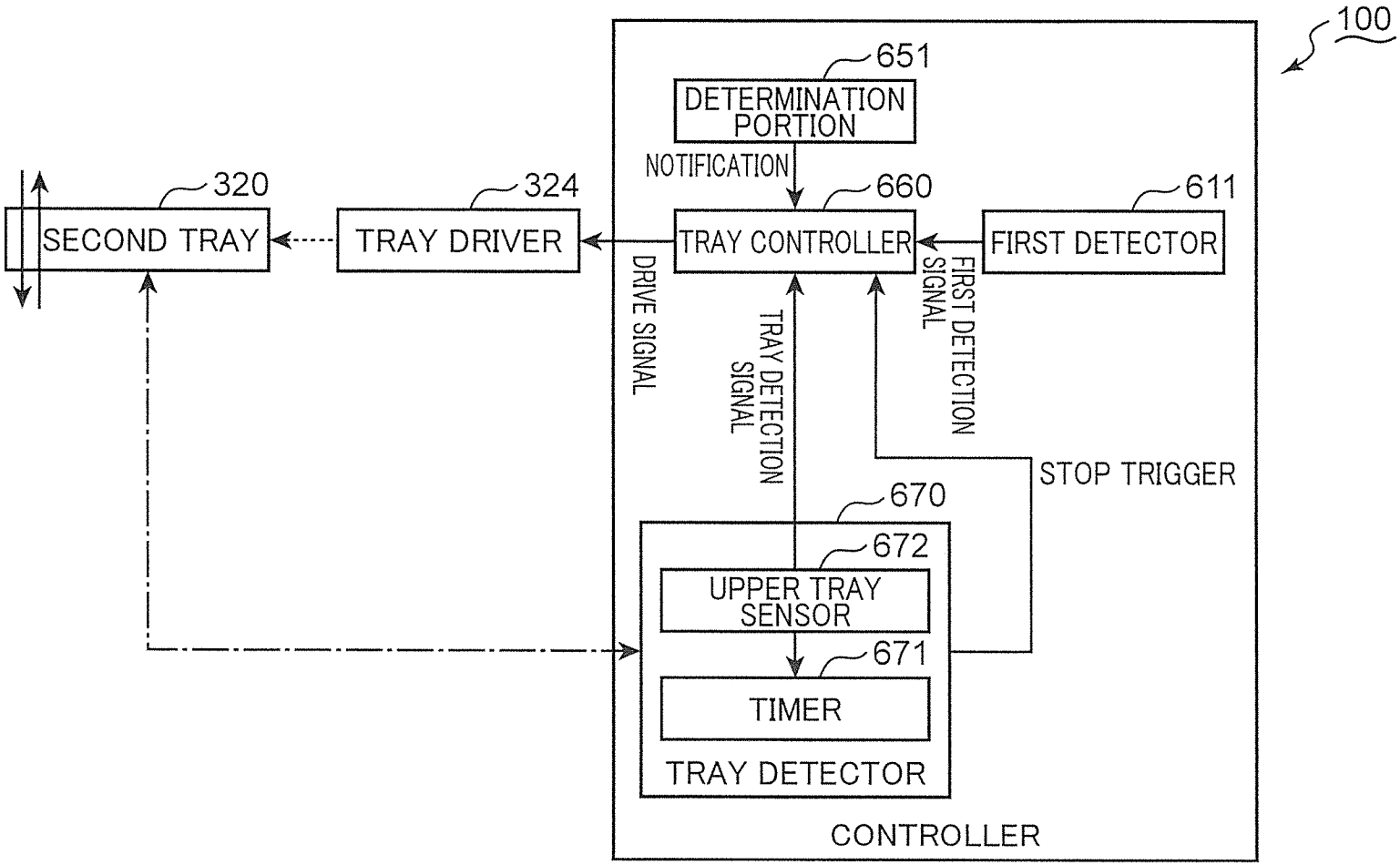
FIG. 14 is a schematic block diagram showing an exemplary functional configuration of the post-processing apparatus.

FIG. 14 is a schematic block diagram showing an exemplary functional configuration of the post-processing apparatus 100. The post-processing apparatus 100 is further described with reference to FIGS. 1, 6 and 14. The solid line in FIG. 14 conceptually indicates signal transmission. The dotted line in FIG. 14 conceptually indicates force transmission. The one-dot chain line in FIG. 14 conceptually indicates detection operation.

The post-processing apparatus 100 further includes a tray driver 324 for driving the second tray 320. The tray driver 324 moves the second tray 320 downwardly from a first height position (the position of the second tray 320 shown in FIG. 1) under control of the controller 600. The tray driver 324 may include a motor (not shown), and a transmission mechanism (e.g. a combination of a belt and a pulley: not shown) designed to convert torque from the motor into a vertical movement of the second tray 320. Alternatively, the tray driver 324 may include a cylinder device (not shown) coupled to the second tray 320. The principle of the present embodiment is not limited to a specific mechanism of the tray driver 324.

The controller 600 further includes a tray controller 660 for controlling the tray driver 324, and a tray detector 670 for detecting the second tray 320. The tray detector 670 generates a tray detection signal when the tray detector 670 detects the second tray 320. The tray detection signal is output to the tray controller 660. The tray controller 660 receives signals from the determination portion 651 and the first detector 611. It is notified from the determination portion 651 not only to the ejection request portion 652 and the operation request portion 653 but also the tray controller 660 that the count value becomes coincident with the total sheet number. The first detector 611 outputs the first detection signal to the tray controller 660. The tray controller 660 controls the tray driver 324 on the basis of the tray detection signal, the first detection signal and the notification from the determination portion 651.

The tray detector 670 for outputting the tray detection signal to the tray controller 660 includes a timer 671 and an upper tray sensor 672. The timer 671 is used to measure a length of a time period during which the second tray 320 is moved downwardly. The upper tray sensor 672 is used to detect an upper surface of a sheet stack on the second tray 320. The upper tray sensor 672 may be a reflective optical sensor forming a detection region defined at a second height position higher than the first height position. The tray driver 324 moves the second tray 320 upwardly under control of the tray controller 660 until the upper tray sensor 672 detects the second tray 320.

Figure 15:
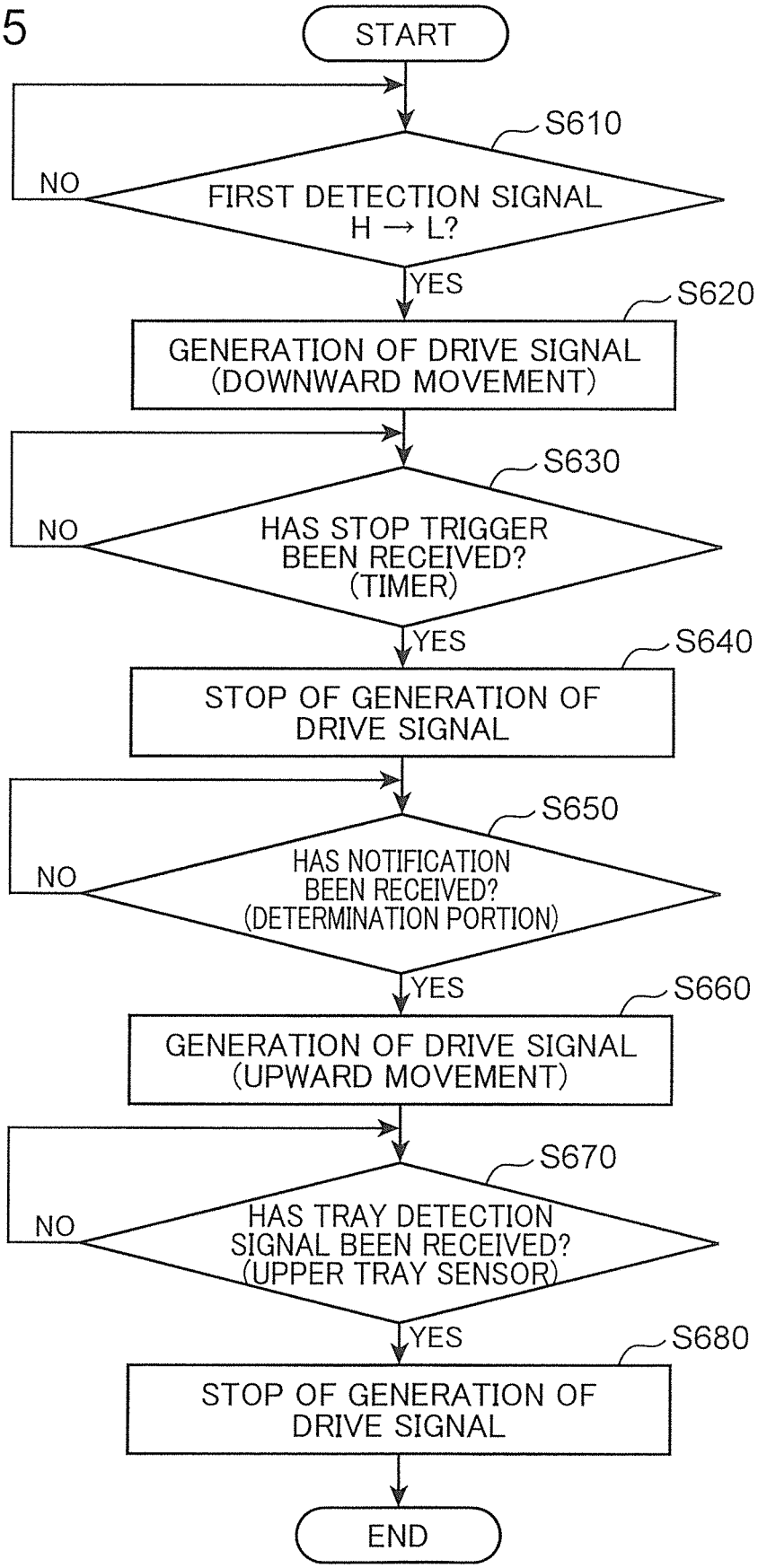
FIG. 15 is a schematic flowchart showing an exemplary process which is executed by a tray controller of the post-processing apparatus.

FIG. 15 is a schematic flowchart showing exemplary processes which are executed by the tray controller 660. The operations of the tray controller 660 are described with reference to FIGS. 1, 6, 14 and 15.

(Step S610)

The tray controller 660 refers to the first detection signal, and waits for a change from the high voltage level to the low voltage level in the first detection signal. The change from the high voltage level to the low voltage level means that the first ejector 210 completes the ejection of the first sheet. When there is the change from the high voltage level to the low voltage level, step S620 is executed.

(Step S620)

The tray controller 660 generates a drive signal for causing the downward movement of the second tray 320. The drive signal is output from the tray controller 660 to the tray driver 324. The tray driver 324 moves the second tray 320 downwardly in response to the drive signal. Accordingly, there is an increase in distance from the roller 221 of the second ejector 220 to the proximal end 321 of the second tray 320. Since the second blower 420 blows air downwardly as mentioned above, the first sheet is largely curved downwardly. Therefore, the subsequent sheet is not excessively strongly rubbed with the first sheet. After the generation of the drive signal, step S630 is executed.

(Step S630)

When the second try 320 is moved downwardly under control of the tray controller 660, a voltage of the tray detection signal output from the upper tray sensor 672 changes from a high voltage level to a low voltage level (i.e. a change from a condition in which the upper tray sensor 672 detects the upper surface of a sheet stack on the second tray 320 to a condition in which the upper tray sensor 672 does not detect the upper surface of the sheet stack on the second tray 320). When there is a change in the voltage of the tray detection signal from the high level to the low level, the timer 671 starts measuring time. After the elapse of a given time period from a start time of the time measurement, the timer 671 generates a stop trigger. The stop trigger is output from the timer 671 to the tray controller 660. In the step S630, the tray controller 660 waits for receiving the stop trigger from the timer 671. When the tray controller 660 receives the stop trigger from the timer 671, step S640 is executed.

(Step S640)

The tray controller 660 stops generating the drive signal in response to receiving the stop trigger. Accordingly, the tray driver 324 and the second tray 320 are stopped. After the stop of the generation of the drive signal, step S650 is executed.

(Step S650)

The tray controller 660 waits the notification from the determination portion 651. As described with reference to FIG. 6, the notification from the determination portion 651 is generated when the second sheet (i.e. the last sheet in a sheet stack) is ejected from the first ejector 210. When the tray controller 660 receives the notification from the determination portion 651, step S660 is executed.

(Step S660)

The tray controller 660 generates a drive signal for causing an upward movement of the second tray 320. The drive signal is output from the tray controller 660 to the tray driver 324. The tray driver 324 moves the second tray 320 upwardly in response to the drive signal. After the generation of the drive signal, step S670 is executed.

(Step S670)

The tray controller 660 waits for receiving the tray detection signal from the upper tray sensor 672. When the tray controller 660 receives the tray detection signal from the upper tray sensor 672, step S680 is executed.

(Step S680)

The tray controller 660 stops generating the drive signal. Accordingly, the tray driver 324 and the second tray 320 are stopped. Since the second tray 320 is stopped at the second height position higher than the position shown in FIG. 1 at this time, there is a very small difference in height between the roller 221 of the second ejector 220 and the second tray 320. Therefore, a sheet stack formed on the first tray 310 may be smoothly ejected to the second tray 320.

<Control of Second Tray Based on Size of First Sheet>

If the first sheet temporarily held in the first tray 310 largely protrudes from the first tray 310 toward the second tray 320, a contact area between the first sheet and the subsequent sheet becomes significantly large. In this case, the first sheet becomes more likely to be pushed in the ejection direction by the subsequent sheet. On the other hand, if the first sheet does not protrude from the first tray 310 toward the second tray 320 so much, there may be a small contact area between the first sheet and the subsequent sheet. In this case, the first sheet is less likely to be pushed in the ejection direction by the subsequent sheet. In short, the first sheet is appropriately held by the first tray 310 without the downward movement of the second tray 320. Control of the downward movement of the second tray 320 on the basis of the size of the first sheet is described blow.

Figure 16:
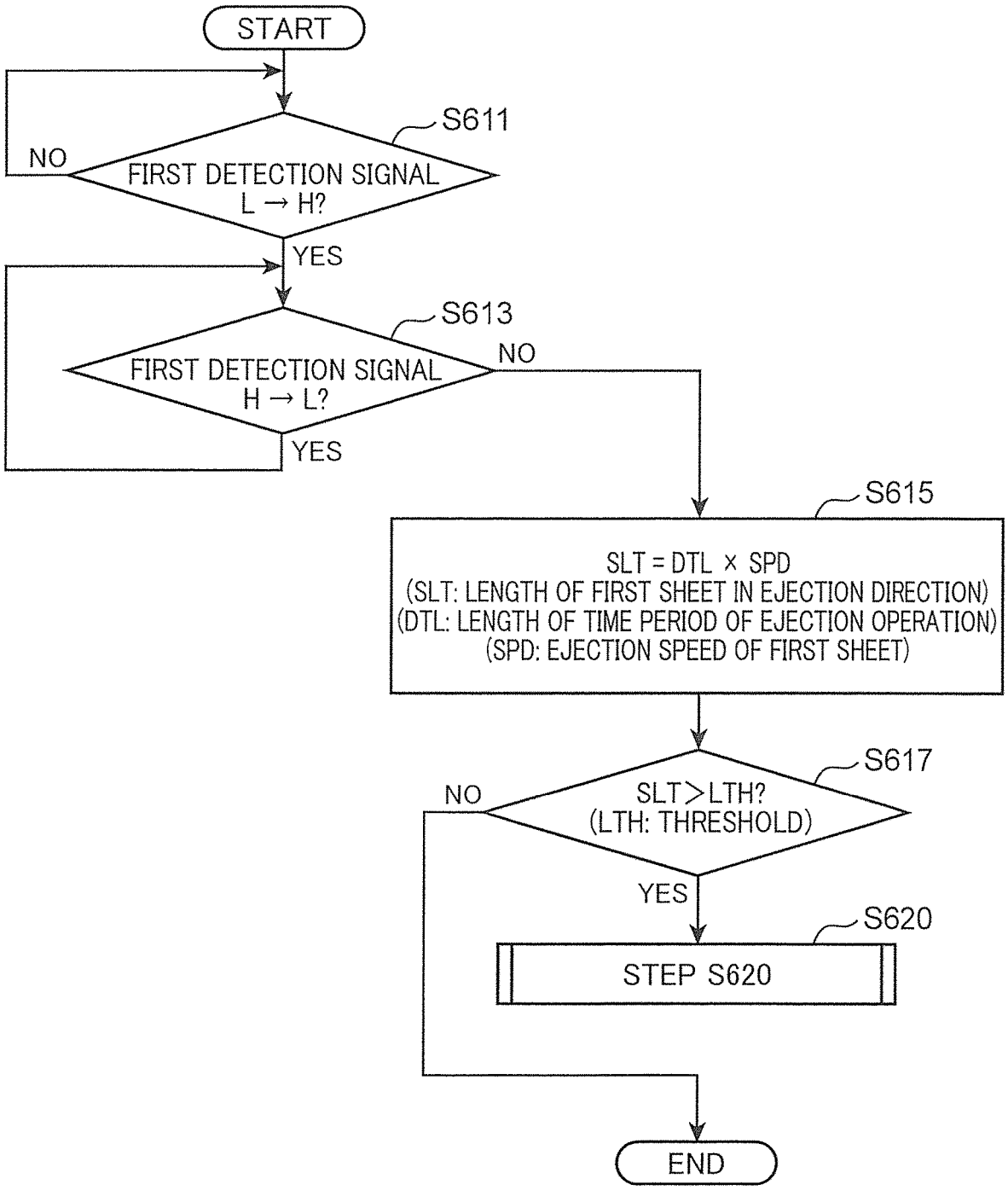
FIG. 16 is a schematic flowchart showing an operation of the tray controller.

FIG. 16 is a schematic flowchart showing operations of the tray controller 660. The operations of the tray controller 660 are described with reference to FIGS. 3 to 5 and 16.

Steps S611 to S617 shown in FIG. 16 are processes in the step S610 described with reference to FIG. 15. Through the processes of the steps S611 to S617, it is determined whether or not the step S620 (generation of the drive signal for moving the second tray 320 downwardly) described with reference to FIG. 15 should be performed.

(Step S611)

The tray controller 660 waits for a change from the low voltage level to the high voltage level in the first detection signal (c.f. FIG. 5). When there is the change from the low voltage level to the high voltage level in the first detection signal, the tray controller 660 stores a clock time when the change from the low voltage level to the high voltage level has happened to the first detection signal. Step S613 is then executed.

(Step S613)

The tray controller 660 waits for a change from the high voltage level to the low voltage level in the first detection signal (c.f. FIG. 5). When there is the change from the high voltage level to the low voltage level in the first detection signal, the tray controller 660 stores a clock time when the change from the high voltage level to the low voltage level has happened to the first detection signal. Step S615 is then executed.

(Step S615)

The tray controller 660 subtracts the time clock data stored in the step S613 from the time clock data stored in the step S611. Consequently, the tray controller 660 may calculate a time length of the first period described with reference to FIG. 3. The tray controller 660 multiplies the calculated time length by an ejection speed of the first sheet. The ejection speed of the first speed is a predetermined fixed value. As a result of the multiplication, the tray controller 660 may obtain data about the length of the first sheet in the ejection direction. After the calculation of the length of the first sheet, step S617 is executed.

(Step S617)

The tray controller 660 compares the length of the first sheet with a given threshold. If the length of the first sheet is greater than the threshold, the step S620 is executed. The given threshold may be set so that the step S620 is executed when an area more than one-half of the entire surface region of the first sheet protrudes from the first tray 310. If the length of the first sheet is not greater than the threshold, the tray controller 660 terminates the process. Accordingly, the second tray 320 is stayed at the first height position without being unnecessarily moved downwardly. In short, the post-processing apparatus 100 may avoid wasting electric power.

The tray controller 660 calculates the length of the first sheet on the basis of the first detection signal. Alternatively, like the blower controller 640 in FIG. 13, the tray controller 660 may receive the sheet size information from the image forming apparatus IFA to obtain information indicative of the length of the first sheet from the received sheet size information. On the other hand, the blower controller 640 may calculate the length of the first sheet by executing the same calculation process as the calculation shown in FIG. 16 (the steps S611 to S615).

<Alignment Portion>

The first tray 310 performs an alignment operation of adjusting positions of sheets stacked on the support surface 318 of the first tray 310*b* so that edges of the sheets on the first tray 310 overlap each other. The alignment operation of the first tray 310 is described below.

Figure 17:
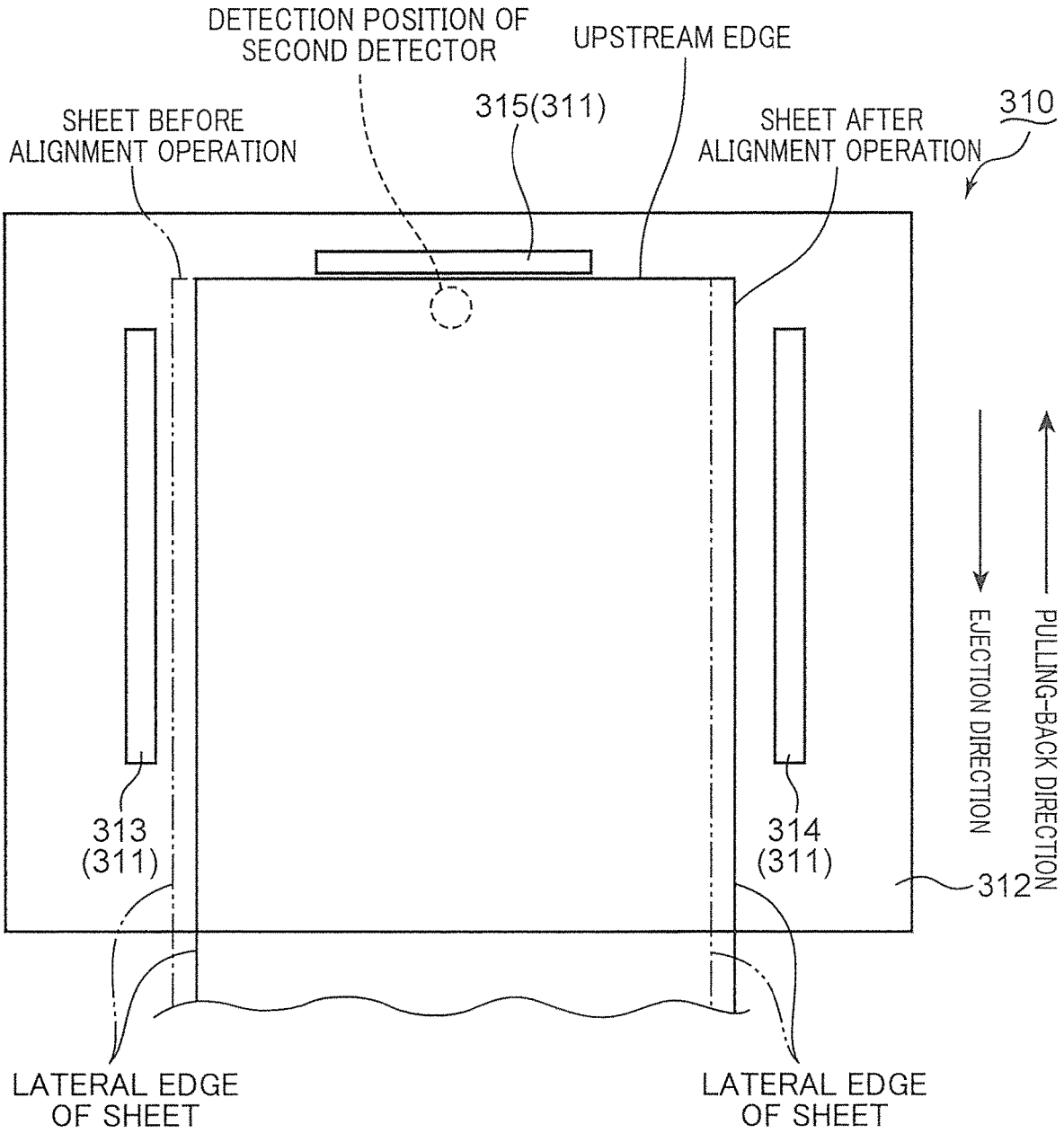
FIG. 17 is a schematic plan view of a first tray of the post-processing apparatus.

FIG. 17 is a schematic plan view of the first tray 310. The alignment operation of the first tray 310 is described with reference to FIGS. 4 and 17.

The first tray 310 includes a support plate 312 forming the support surface 318, two cursors 313, 314, a stopper 315, a motor (not shown) for driving the cursors 313, 314. The support plate 312 supports the first sheet and at least one subsequent sheet, which are sequentially ejected from the first ejector 210. The cursors 313, 314 are driven by the motor so as to adjust a position of lateral edges of the sheets on the support plate 312. A position of the upstream edges (edges of the upstream side in the ejection direction) of the sheets on the support plate 321 is set by the stopper 315. Each of the cursors 313, 314 and the stopper 315 stands upwardly from the upper surface of the support plate 312. By the stopper 315, the cursors 313, 314 and the motor, which drives the cursors 313 314, an alignment portion 311 is formed.

The stopper 315 is situated so that the upstream edges of the first sheet and the subsequent sheet hit the stopper 315. A detection position of the second detector 612 is set near the stopper 315. The second detector 612 outputs the second detection signal when the upstream edges of the first sheet moves into the detection position of the second detector 612.

The motor reciprocates the cursors 313, 314 in a direction orthogonal to the ejection direction in response to the second detection signal. Any of techniques used in various sheet alignment mechanisms incorporated in known post-processing apparatuses may be applied to a conversion mechanism for converting rotation of the motor into linear reciprocation of the cursors 313, 314. Therefore, the principle of the present embodiment is not limited to a specific conversion mechanism.

Operation of the alignment portion 311 is described below.

When sheets are sequentially sent in the pulling-back direction by the second ejector 220 and the pulling-back mechanism 500, upstream edges of these sheets hit the stopper 315. Accordingly, a position of the sheets in the ejection direction is fixed. Subsequently, the cursors 313, 314 are moved in directions causing them to come closer to each other. Consequently, a position of the sheets is appropriately adjusted in the direction orthogonal to the ejection direction so that the lateral sheet edges in a sheet stack overlap each other.

Subsequently, the cursors 313, 314 are moved in directions causing them to come away from each other. Accordingly, the subsequent sheet may enter a region between the cursors 313, 314 without interference with the cursors 313, 314.

The cursors 313, 314 are reciprocated after the pulling-back operation of the pulling-back mechanism 500. Therefore, the cursors 313, 314 are reciprocated in collaboration with the pulling-back operation of the pulling-back mechanism 500 under control of the pulling-back controller 630. Processes of the pulling-back controller 630 are described below.

Figure 18:
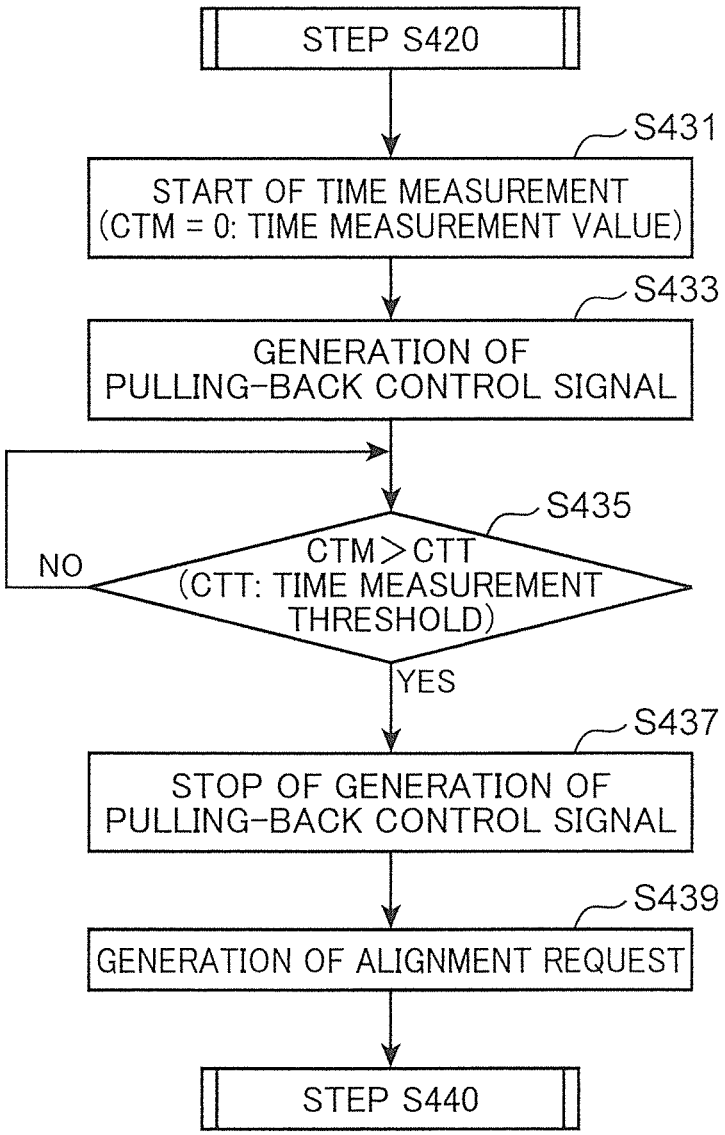
FIG. 18 is a schematic flowchart showing an exemplary process which is executed by a pulling-back controller.

FIG. 18 is a schematic flowchart showing exemplary processes which are executed by the pulling-back controller 630 in the step S430 (c.f. FIG. 9). The processes of the pulling-back controller 630 are described with reference to FIGS. 2, 4 and 18.

(Step S431)

The pulling-back controller 630 starts a time measurement. A time measurement value is increased from "0". When the pulling-back controller 630 starts the time measurement, step S433 is executed.

(Step S433)

The pulling-back controller 630 generates the pulling-back control signal. The pulling-back control signal is output from the pulling-back controller 630 to the paddle driver 530. The paddle driver 530 rotates the rotary shaft 510 in response to the pulling-back control signal. Accordingly, the paddle arm 520 sends the subsequent sheet in the pulling-back direction, so that the subsequent sheet is supplied onto the first tray 310. When the pulling-back controller 630 generates the pulling-back control signal, step S435 is executed.

(Step S435)

The pulling-back controller 630 compares the time measurement value with a given time measurement threshold. If the time measurement value is greater than the time measurement threshold, step S437 is executed.

(Step S437)

The generation of the pulling-back control signal by the pulling-back controller 630 is stopped. Accordingly, the paddle driver 530 is stopped so that the pulling-back operation of the pulling-back mechanism 500 is terminated. After the stop of the generation of the pulling-back control signal, step S439 is executed.

(Step S439)

The pulling-back controller 630 generates an alignment request.

Figure 19:
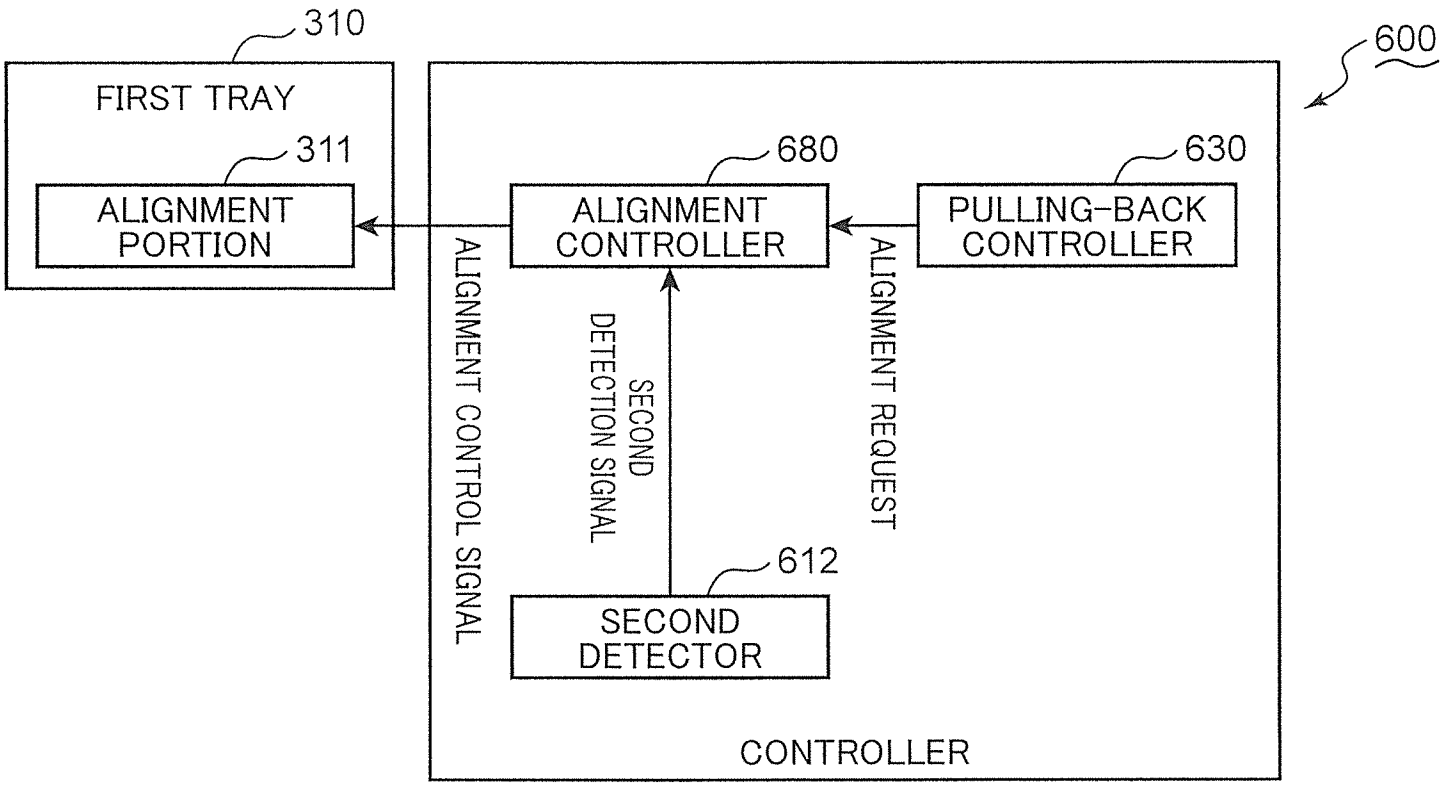
FIG. 19 is a schematic block diagram showing an exemplary functional configuration to make an aligning operation of an alignment portion in collaboration with a pulling-back operation of a pulling-back mechanism of the post-processing apparatus.

FIG. 19 is a schematic block diagram showing an exemplary functional configuration to make the aligning operation of the alignment portion 311 in collaboration with the pulling-back operation of the pulling-back mechanism 500. The post-processing apparatus 100 is further described with reference to FIGS. 18 and 19.

The controller 600 further includes an alignment controller 680 for controlling the alignment portion 311. The alignment request generated in the step S439 is output from the pulling-back controller 630 to the alignment controller 680. The alignment controller 680 receives the second detection signal from the second detector 612 in addition to the alignment request.

When the second detection signal changes from the low voltage level to the high voltage level, the alignment controller 680 generates an alignment control signal. The alignment control signal is output from the alignment controller 680 to the alignment portion 311. Therefore, the cursors 313, 314 are reciprocated in the directions substantially perpendicular to the ejection direction in response to the alignment control signal. Accordingly, the first sheet is set in position on the first tray 310. Subsequently, the alignment controller 680 generates the alignment control signal whenever the alignment controller 680 receives the alignment request. Therefore, the cursors 313, 314 reciprocates in the direction substantially perpendicular to the ejection direction to align the subsequent sheet with the first sheet so that the lateral edge of the subsequent sheet overlaps the lateral edge of the first sheet whenever the pulling-back controller 630 outputs the alignment request.

Figure 20:
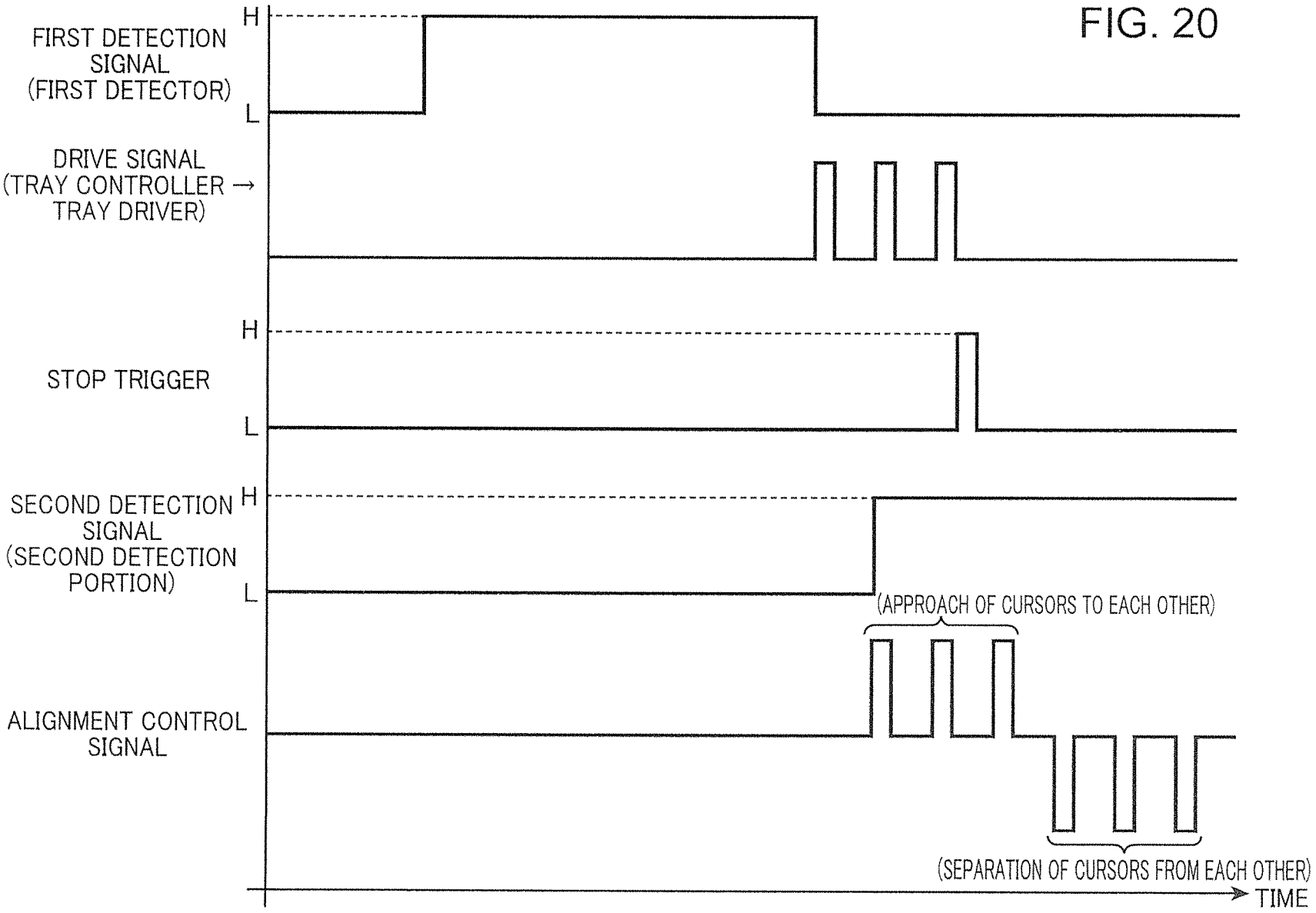
FIG. 20 is a timing chart of detection signals from a first detector and a second detector, a drive signal output from the tray controller to a tray driver, a stop trigger output to the tray controller and an alignment control signal.

FIG. 20 is a timing chart of the detection signals from the first and second detectors 611, 612, the drive signal output from the tray controller 660 to the tray driver 324, the stop trigger output from the timer 671 to the tray controller 660, and the alignment control signal. A relationship among these signals is described with reference to FIGS. 1, 4, 14, 17, 19 and 20.

Before the first sheet moves into the detection position (c.f. FIG. 17) of the second detector 612, the first sheet is moved in the pulling-back direction by the second ejector 220. Therefore, the second detection signal from the second detector 612 changes from the low voltage level to the high voltage level with a delay of a given time period from a time when the first direction signal from the first detector 611 changes from the high voltage level to the low voltage level (i.e. a time when the first ejector 210 has completed ejection of the first sheet). When the second detection signal from the second detector 612 is the high voltage, the second detector 612 detects the first sheet on the first tray 310.

When the second detection signal from the second detector 612 changes from the low voltage level to the high voltage level, the alignment controller 680 outputs the alignment control signal for a given time period so that the cursors 313, 314 come closer to each other. After an elapse of the given time period, the alignment controller 680 outputs the alignment control signal for a given time period so that the cursors 313, 314 come away from each other. As shown in FIG. 20, before the output of these alignment control signals are terminated, the stop trigger is output from the timer 671 to the tray controller 660. This means that the downward movement of the second tray 320 is stopped before the alignment portion 311 completes the positional adjustment to the first sheet. In short, a time period for the downward movement of the second tray 320 overlaps a time period required for the alignment portion 311 to adjust the position of the first sheet. Therefore, it is not necessary to separately set the time period for the downward movement of the second tray 320.

<Advantageous Effects of Smooth Sheet Conveyance>

The blower controller 640 makes the first blower 410 blow air over a time period in synchronization with the first time period from the start to the end of the ejection of the first sheet to form an airflow between the second tray 320 and the lower surface of the first sheet when the first sheet is ejected from the first ejector 210. Accordingly, there is a reduced frictional force between the second tray 320 and the first sheet. Therefore, the first sheet is conveyed in the pulling-back direction without being interfered by the frictional force between the second tray 320 and the first sheet, and smoothly held on the first tray 310.

The air-blow from the first blower 410 is stopped after the first time period. Therefore, the frictional force between the second tray 320 and the first sheet increases after the first time period. Accordingly, the first sheet becomes less likely to be pushed by the subsequent sheet ejected subsequently to the first sheet.

The second blower 420 contributes to smooth sheet conveyance as well as the first blower 410. The second blower 420 blows air to the upper surface region of a sheet protruding from the second ejector 220 in the ejection direction (i.e. the upper surface region of a sheet appearing over the second tray 320). Accordingly, the sheet is curved toward the second tray 320 extending in the ejection direction from a region beneath the second ejector 220, so that the sheet moves away from an ejection path of the subsequent sheet. Therefore, a contact area between these sheets is reduced to suppress a risk of the preceding sheet being pushed by the subsequent sheet.

When the second blower 420 blows air so that a sheet is curved downwardly, the first sheet, which is a sheet initially ejected from the first ejector 210 among sheets in a sheet stack, is pressed against the upper surface of the second tray 320. However, since the second blower 420 blows air in a smaller volume than the first blower 410, the first sheet is not pressed against the second tray 320 by an excessively strong force.

The tray driver 324 also contributes to a sheet being curved downwardly. Under control of the tray controller 660, the tray driver 324 moves the second tray 320 downwardly from the first height position after the first time period. Along with the downward movement of the second tray 320, the sheet protruding from the first tray 310 toward the second tray 320 is curved downwardly, so that the sheet moves away from the ejection path of the subsequent sheet. Accordingly, a contact area between these sheets is reduced so that there is a decreased risk of the preceding sheet being pushed by the subsequent sheet.

The downward movement of the second tray 320 is completed before the alignment portion 311 completes the adjusting operation for adjusting a position of a sheet on the first tray 310. The downward movement of the second tray 320 is completed within a time period during which the alignment portion 311 adjusts the position of the sheet on the first tray 310, so that a time period exclusively used for the downward movement of the second tray 320 is not required.

It is determined on the basis of a sheet length in the ejection direction whether or not the second tray 320 should be moved downwardly. If the sheet length is not greater than a given length, a preceding sheet is much less likely to be pushed by a subsequent sheet. Therefore, when the sheet length is not greater than the given length, the tray controller 660 for controlling the tray driver 324 stays the second tray 320 at the first height position (the position of the second tray 320 shown in FIG. 1). Accordingly, electric power for driving the second tray 320 is not wasted.

Likewise, the blower controller 640 for controlling the first and second blowers 410, 420 makes the first and second blowers 410, 420 blow air on the condition that the first sheet is longer than the given length. Accordingly, electric power for the air-blow is not wasted.

While the first ejector 210 ejects the first sheet, the first blower 410 blows air under control of the first blower controller 641 to reduce a frictional force between the lower surface of the first sheet and the second tray 320. After the first sheet is received in the first tray 310, the airflow for reducing the frictional force between the lower surface of the first sheet and the second tray 320 becomes unnecessary. Therefore, the first blower controller 641 stops the air-blow from the first blower 410 when the first sheet is received in the first tray 310. Accordingly, electric power for the air-blow is not wasted. However, if a large number of subsequent sheets are stacked on the first sheet, the lower surface of the first sheet may come into close contact with the upper surface of the second tray 320 due to the weight of the subsequent sheets. Therefore, after a given number of the subsequent sheets are ejected from the first ejector 210, the first blower controller 641 restarts the air-blow from the first blower 410. Accordingly, the first sheet becomes less likely to come into close contact with the second tray 320, so that a sheet stack formed on the first tray 310 is smoothly ejected.

When the sheet stack is formed on the first tray 310, the ejection controller 660 moves the second tray 320 upwardly to the second height position. The second height position is higher than the first height position before the second tray 320 is moved downwardly, so that there is a reduced difference in height between the second tray 320 and the second ejector 220. Accordingly, the sheet stack on the first tray 310 is smoothly ejected onto the second tray 320.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A post-processing apparatus for performing a given process subsequently to an image forming process by an image forming apparatus, comprising:

a first ejector which ejects a first sheet;

a first tray which temporarily holds the first sheet ejected by the first ejector;

a second tray situated downstream of the first tray in an ejection direction of the first sheet;

a tray driver which moves the second tray downwardly from a first height position;

a first blower which forms an airstream between the second tray and a lower surface of the first sheet when the first sheet is ejected by the first ejector; and a controller which controls the first blower and the tray driver, wherein the controller includes:

(i) a first blower controller which causes the first blower to blow air over a time period in synchronization with a first time period from a start to an end of ejection of the first sheet by the first ejector; and (ii) a tray controller which causes the tray driver to move the second tray downwardly from the first height position after the first time period, wherein the tray controller moves the second tray down from the first height position if the first sheet is longer in the ejection direction than a given length, and wherein the second tray is stayed at the first height position if the first sheet is not longer in the ejection direction than the given length.

2. The post-processing apparatus according to claim 1, wherein the controller includes a first detector which detects the first sheet ejected from the first ejector and generates a detection signal indicative of the start and the end of the ejection, and wherein the first blower controller controls the first blower in response to the detection signal.

3. The post-processing apparatus according to claim 2, wherein the tray driver moves the second tray downwardly under control of the tray controller when the first detector detects the end of the ejection of the first sheet.

4. The post-processing apparatus according to claim 1, wherein the first blower blows the air under control of the first blower controller on a condition that the first sheet is longer in the ejection direction than the given length.

5. The post-processing apparatus according to claim 1, wherein the first ejector sequentially ejects at least one subsequent sheet subsequently to the first sheet, wherein the first tray includes an alignment portion which performs an aligning operation for aligning the at least one subsequent sheet with the first sheet so that an edge of the at least one subsequent sheet overlaps an edge of the first sheet to form a sheet stack, and wherein the tray controller moves the second tray downwardly before the alignment portion completes an adjusting operation for adjusting a position of the first sheet on the first tray in a direction orthogonal to the ejection direction.

6. A post-processing apparatus for performing a given process subsequently to an image forming process by an image forming apparatus, comprising:

a first ejector configured to eject a first sheet;

a first tray configured to temporarily hold the first sheet ejected by the first ejector;

a second tray situated downstream of the first tray in an ejection direction of the first sheet;

a tray driver configured to move the second tray downwardly from a first height position;

a first blower configured to form an airstream between the second tray and a lower surface of the first sheet when the first sheet is ejected by the first ejector; and a controller configured to control the first blower and the tray driver, wherein the controller includes:

(i) a first blower controller configured to causes the first blower to blow air over a time period in synchronization with a first time period from the start to the end of ejection of the first sheet by the first ejector; and (ii) a tray controller configured to cause the tray driver to move the second tray downwardly from the first height position after the first time period;

(iii) a first detector configured to detect the first sheet ejected from the first ejector and to generate a detection signal indicative of a start and an end of the ejection, and wherein the first blower controller controls the first blower in response to the detection signal, wherein the tray controller uses the detection signal to calculate a length of the first sheet in the ejection direction and compares the calculated length with a given threshold, wherein the tray controller moves the second tray downwardly from the first height position when the calculated length exceeds the given threshold, and wherein the second tray is stayed at the first height position when the calculated length is not greater than the given threshold.

7. A post-processing apparatus for performing a given process subsequently to an image forming process by an image forming apparatus, comprising:

a first ejector configured to eject a first sheet;

a first tray configured to temporarily hold the first sheet ejected by the first ejector;

a second tray situated downstream of the first tray in an ejection direction of the first sheet;

a tray driver configured to move the second tray downwardly from a first height position;

a first blower configured to form an airstream between the second tray and a lower surface of the first sheet when the first sheet is ejected by the first ejector; and a controller configured to control the first blower and the tray driver, wherein the controller includes:

(i) a first blower controller configured to cause the first blower to blow air over a time period in synchronization with a first time period from a start to an end of ejection of the first sheet by the first ejector; and (ii) a tray controller configured to cause the tray driver to move the second tray downwardly from the first height position after the first time period, wherein the first ejector sequentially ejects at least one subsequent sheet subsequently to the first sheet, wherein the first tray includes an alignment portion configured to perform an aligning operation for aligning the at least one subsequent sheet with the first sheet so that an edge of the at least one subsequent sheet overlaps an edge of the first sheet to form a sheet stack, wherein the tray controller moves the second tray downwardly before the alignment portion completes an adjusting operation for adjusting a position of the first sheet on the first tray in a direction orthogonal to the ejection direction, wherein the tray driver moves the second tray upwardly by a given distance when the first tray holds a second sheet which is the last sheet ejected from the first ejector in the sheet stack.

8. The post-processing apparatus according to claim 7, wherein the second tray moved upwardly by the tray driver reaches a second height position higher than the first height position.

9. A post-processing apparatus for performing a given process subsequently to an image forming process by an image forming apparatus, comprising:

a first ejector configured to eject a first sheet;

a first tray configured to temporarily hold the first sheet ejected by the first ejector;

a second tray situated downstream of the first tray in an ejection direction of the first sheet;

a tray driver configured to move the second tray downwardly from a first height position;

a first blower configured to form an airstream between the second tray and a lower surface of the first sheet when the first sheet is ejected by the first ejector; and a controller configured to control the first blower and the tray driver, a second ejector which ejects the sheet stack from the first tray to the second tray; and a second blower which blows air onto an upper surface of each of the first sheet and the at least one subsequent sheet when each of them is ejected by the first ejector, wherein the controller includes:

(i) a first blower controller configured to cause the first blower to blow air over a time period in synchronization with a first time period from a start to an end of ejection of the first sheet by the first ejector;

(ii) a tray controller configured to cause the tray driver to move the second tray downwardly from the first height position after the first time period; and (iii) a second blower controller which controls the second blower, wherein the tray controller moves the second tray downwardly before an alignment portion completes an adjusting operation for adjusting a position of the first sheet on the first tray in a direction orthogonal to the ejection direction, and wherein the second tray extends in the ejection direction from a region beneath the second ejector.

10. The post-processing apparatus according to claim 9, wherein the second blower blows less air than the first blower.

11. The post-processing apparatus according to claim 9, wherein the controller includes a first detector which detects the first sheet ejected from the first ejector, and wherein the first and second blowers start blowing the air under control of the first and second blower controllers when the first detector detects the start of the ejection of the first sheet.

12. The post-processing apparatus according to claim 9, further comprising:

a pulling-back mechanism which moves the at least one subsequent sheet in a pulling-back direction opposite to the ejection direction to place the at least one subsequent sheet on the first tray, wherein the controller includes:

a pulling-back controller which controls the pulling-back mechanism to move the at least one subsequent sheet in the pulling-back direction; and an alignment controller which controls the aligning operation of the alignment portion, wherein the alignment controller causes the alignment portion to execute the aligning operation when the at least one subsequent sheet is moved in the pulling-back direction under control of the pulling-back controller and placed on the first tray.

13. The post-processing apparatus according to claim 12, wherein the controller includes a first detector which detects the at least one subsequent sheet ejected from the first ejector and generates a detection signal indicative of an end of an ejection of the at least one subsequent sheet, and wherein the pulling-back controller operates the pulling-back mechanism for a given time period when the first detector detects the end of the ejection of the at least one subsequent sheet from the first ejector, and wherein the alignment controller operates the alignment portion after an elapse of the given time period.

14. The post-processing apparatus according to claim 12, wherein the first blower controller stops the first blower in a second time period during which the pulling-back mechanism conveys the at least one subsequent sheet in the pulling-back direction.

15. The post-processing apparatus according to claim 14, wherein the first blower controller operates the first blower after the second time period to restart blowing the air from the first blower.

16. The post-processing apparatus according to claim 15, wherein the controller includes:

a first detector which generates a detection signal indicating that a sheet has passed through the first ejector whenever each of sheets passes through the first ejector; and a counter which refers to the detection signal to count how many sheets have passed through the first ejector and compares a resultant count value with a count threshold, and wherein the first blower controller causes the first blower to restart blowing the air on a condition that the count value is coincident with the count threshold.

17. The post-processing apparatus according to claim 12, wherein the controller includes: an ejection controller which controls the second ejector; and a first detector which detects the start and the end of the ejection of the first sheet from the first ejector, and wherein the second ejector sends the first sheet in the ejection direction under control of the ejection controller, and the first and second blowers start blowing the air under control of the first and second blower controllers when the first detector detects the start of the ejection of the first sheet; and wherein the second ejector sends the first sheet in the pulling-back direction under control of the ejection controller to supply the first sheet onto the first tray, and the first blower stops blowing the air under control of the first blower controller when the first detector detects the end of the ejection of the first sheet.

18. The post-processing apparatus according to claim 12, wherein the controller includes: an ejection controller which controls the second ejector; a first detector which detects the start and the end of the ejection of the first sheet from the first ejector; and a second detector which detects the first sheet on the first tray, and wherein the second ejector sends the first sheet in the ejection direction under control of the ejection controller, and the first and second blowers start blowing the air under control of the first and second blower controllers when the first detector detects the start of the ejection of the first sheet;

wherein the second ejector sends the first sheet in the pulling-back direction under control of the ejection controller to supply the first sheet onto the first tray when the first detector detects the end of the ejection of the first sheet; and wherein the first blower stops blowing the air under control of the first blower controller when the second detector detects the first sheet.

19. The post-processing apparatus according to claim 17, wherein the second ejector includes a first roller, and a second roller which is displaceable between an adjacent position adjacent to the first roller and a distant position distant from the first roller, and wherein the ejection controller places the second roller at the adjacent position, and bi-directionally rotates the first roller so that the first sheet is moved in the ejection direction and then in the pulling-back direction when the first sheet is ejected from the first ejector;

wherein the ejection controller places the second roller at the distant position when the at least one subsequent sheet is ejected from the first ejector; and wherein the ejection controller rotates the first roller so that the sheet stack is moved in the ejection direction when the sheet stack is formed on the first tray.

* * * * *